US008978199B2

(12) United States Patent
Kasper et al.

(10) Patent No.: US 8,978,199 B2
(45) Date of Patent: Mar. 17, 2015

(54) VACUUM CLEANER WITH DEBRIS COLLECTOR

(71) Applicant: BISSELL Homecare, Inc., Grand Rapids, MI (US)

(72) Inventors: Gary A. Kasper, Grand Rapids, MI (US); Aaron P. Griffith, Grand Rapids, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 0 days.

(21) Appl. No.: 14/163,304

(22) Filed: Jan. 24, 2014

(65) Prior Publication Data

US 2014/0215751 A1 Aug. 7, 2014

Related U.S. Application Data

(60) Provisional application No. 61/759,697, filed on Feb. 1, 2013.

(51) Int. Cl.
*A47L 9/10* (2006.01)
*A47L 9/16* (2006.01)

(52) U.S. Cl.
CPC ..... *A47L 9/104* (2013.01); *A47L 9/106* (2013.01); *A47L 9/1666* (2013.01); *A47L 9/1683* (2013.01); *Y10S 55/03* (2013.01)
USPC ..... 15/347; 15/353; 55/337; 55/426; 55/DIG. 3

(58) Field of Classification Search
CPC ..... A47L 9/1683
USPC ..... 15/347, 352, 353; 55/337, 426, 428, 55/459, DIG. 3
IPC ..... A47L 9/10, 9/16
See application file for complete search history.

(56) References Cited

U.S. PATENT DOCUMENTS

| | | | |
|---|---|---|---|
| 2,708,765 | A | 5/1955 | Vann |
| 4,225,997 | A | 10/1980 | Thomas et al. |
| 6,129,775 | A | 10/2000 | Conrad et al. |
| 6,228,151 | B1 | 5/2001 | Conrad et al. |
| 6,419,719 | B2 | 7/2002 | Conrad et al. |
| 6,427,633 | B1 | 8/2002 | Ogden |
| 6,461,508 | B1 | 10/2002 | Thomson |
| 6,533,834 | B2 | 3/2003 | Conrad et al. |
| 6,616,721 | B2 | 9/2003 | Oh |
| 6,810,557 | B2 | 11/2004 | Hansen et al. |
| 7,014,671 | B2 | 3/2006 | Oh |
| 7,491,255 | B2 | 2/2009 | Jung |
| 7,559,965 | B2 | 7/2009 | Oh et al. |
| 7,632,324 | B2 | 12/2009 | Makarov et al. |
| 7,708,789 | B2 | 5/2010 | Fester |
| 7,748,079 | B2 | 7/2010 | McDowell et al. |
| 7,918,909 | B2 | 4/2011 | McDowell |
| 8,167,981 | B2 | 5/2012 | Webb |
| 2013/0219654 | A1 | 8/2013 | Ruben |

FOREIGN PATENT DOCUMENTS

| | | | |
|---|---|---|---|
| CN | 201409878 | Y | 2/2010 |
| WO | 9627446 | A1 | 9/1996 |
| WO | 02078505 | A2 | 10/2002 |

*Primary Examiner* — David Redding

(74) *Attorney, Agent, or Firm* — McGarry Bair PC

(57) ABSTRACT

A vacuum cleaner with a separation module includes an exhaust grill having openings through which air may pass, wherein the exhaust grill is positioned fluidly between a separator chamber and an air outlet. A plurality of debris catching tines prevent debris from wrapping around and blocking the openings of the exhaust grill.

20 Claims, 21 Drawing Sheets

VACUUM CLEANER WITH DEBRIS COLLECTOR

CROSS-REFERENCE TO RELATED APPLICATION(S)

This application claims the benefit of U.S. Provisional Patent Application No. 61/759,697, filed Feb. 1, 2013, which is incorporated herein by reference in its entirety.

BACKGROUND

Upright vacuum cleaners employ collection systems for separating and collecting contaminants from a working airstream for later disposal. Some collection systems can include a cyclone separator for separating contaminants from a working airstream and a removable dirt cup for receiving and collecting the separated contaminants from the cyclone separator. The cyclone separator can have a single cyclonic separation stage, or multiple stages. In another arrangement, the collection system can include an integrally-formed cyclone separator and dirt cup, with the dirt cup being provided with a bottom-opening dirt door for contaminant disposal. Other types of collection systems such as centrifugal separators or bulk separators use high-speed rotational motion of the air/debris to separate the dirt by centrifugal force.

Typically, working air enters and exits at an upper portion of the collection system, as the lower portion of the collection system is used to collect debris. Before exiting the collection system or passing to a downstream separation stage, the working air may flow through an exhaust grill. The exhaust grill can have openings through which air may pass. The openings may be defined by perforations or holes, or may be defined between spaced vanes or louvers. During operation, the openings of the exhaust grill may become blocked or clogged with debris, requiring periodic cleaning of the exhaust grill.

BRIEF SUMMARY

According to one embodiment of the invention, a vacuum cleaner includes a housing comprising a suction nozzle, a suction source fluidly connected to the suction nozzle creating a working airstream through the housing, a separation module separating contaminants from the working airstream, and an exhaust grill assembly. The separation module includes at least one separation chamber having an air inlet in fluid communication with the suction nozzle, an air outlet, and at least one collection chamber which receives contaminants separated by the at least one separation chamber. The exhaust grill assembly has an exhaust grill having openings through which the working airstream may pass and mounted within the at least one separation chamber fluidly upstream from the air outlet such that the working airstream passes through the openings of the exhaust grill before reaching the air outlet, and a plurality of debris catching tines extending below the exhaust grill within the at least one collection chamber which prevent elongated debris from wrapping around and blocking the openings of the exhaust grill.

DETAILED DESCRIPTION

The invention relates to vacuum cleaners and in particular to vacuum cleaners having cyclonic dirt separation. In one of its aspects, the invention relates to an improved exhaust grill for a cyclone module assembly. For purposes of description related to the figures, the terms "upper," "lower," "right," "left," "rear," "front," "vertical," "horizontal," and derivatives thereof shall relate to the invention as oriented in FIG. 1 from the perspective of a user behind the vacuum cleaner, which defines the rear of the vacuum cleaner. However, it is to be understood that the invention may assume various alternative orientations, except where expressly specified to the contrary.

Figure 1:
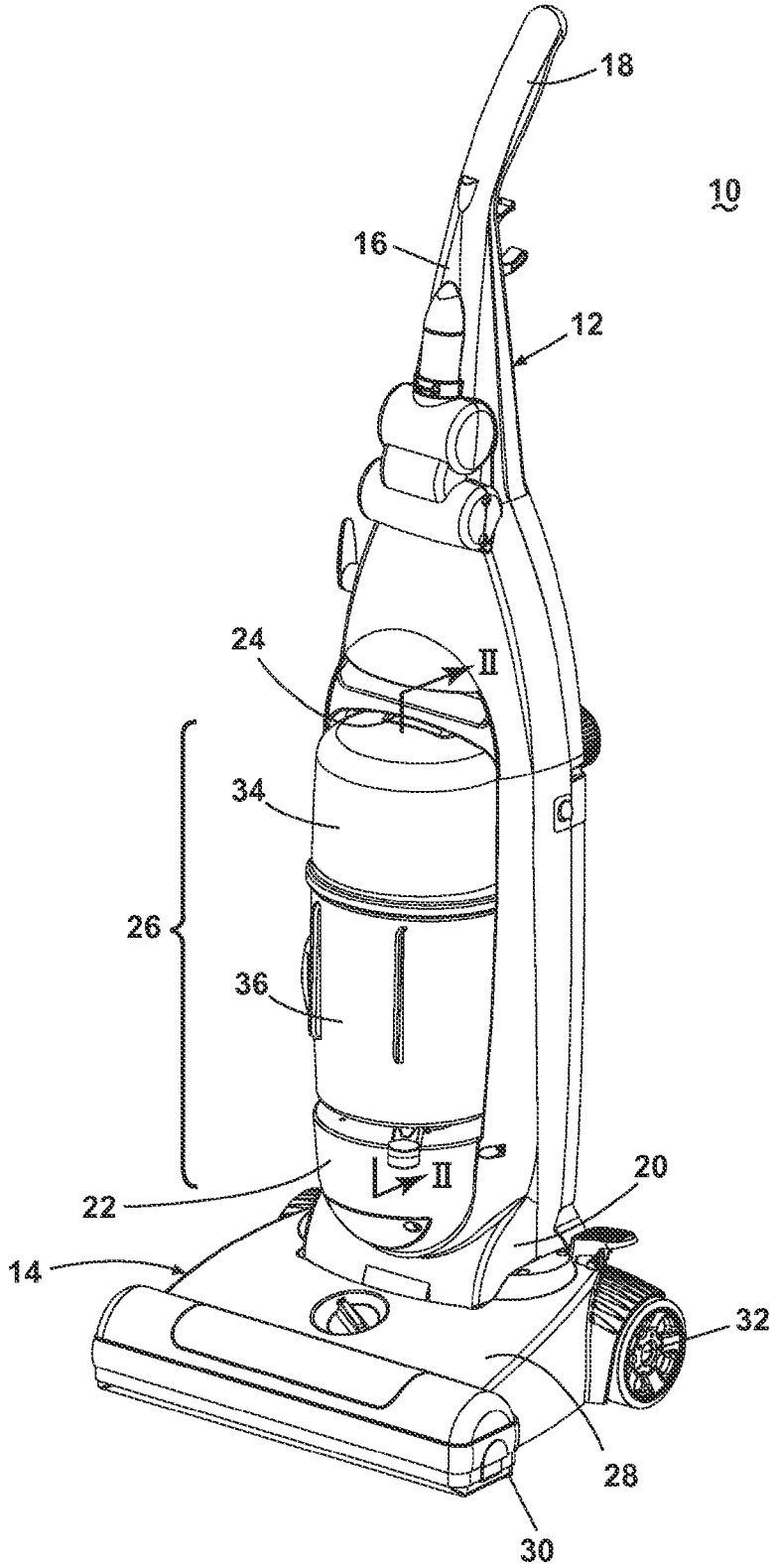
FIG. 1 is a perspective view of a vacuum cleaner having a separation module according to the invention.

Referring to the drawings, and in particular to FIG. 1, an upright vacuum cleaner 10 comprises an upright handle assembly 12 pivotally mounted to a foot assembly 14. The handle assembly 12 further comprises a primary support section 16 with a grip 18 on one end to facilitate movement by a user. A motor cavity 20 is formed at an opposite end of the handle assembly 12 to contain a conventional suction source such as a vacuum fan/motor assembly (not shown) oriented transversely therein. A post-motor filter housing 22 is formed above the motor cavity 20 and is in fluid communication with the vacuum fan/motor assembly. The handle assembly 12 pivots relative to the foot assembly 14 through a pivot axis that is coaxial with a motor shaft (not shown) associated with the vacuum fan/motor assembly. Alternatively, the handle assembly 12 can be coupled to the foot assembly 14 by a multi-axis joint. A mounting section 24 on the primary support section 16 of the handle assembly 12 receives a collection system 26 according to a first embodiment of the invention for separating and collecting contaminants from a working airstream for later disposal. In one conventional arrangement illustrated herein, the collection system 26 is shown as a cyclone separation module 26. However, it is understood that other types of separation modules can be used, such as centrifugal separators or bulk separators. The vacuum cleaner 10 can also be provided with one or more additional filters upstream or downstream of the collection system 18.

The foot assembly 14 comprises a housing 28 with a suction nozzle 30 formed at a lower surface thereof and that is in fluid communication with the vacuum fan/motor assembly. While not shown, an agitator can be positioned within the housing 28 adjacent the suction nozzle 30 and operably connected to a dedicated agitator motor, or to the vacuum fan/motor assembly within the motor cavity 20 via a stretch belt as is common in the vacuum cleaner art. Rear wheels 32 are secured to a rearward portion of the foot assembly 14 and a pair of support wheels (not shown) is secured to a forward portion of the foot assembly 14 for moving the foot assembly 14 over a surface to be cleaned.

Figure 2:
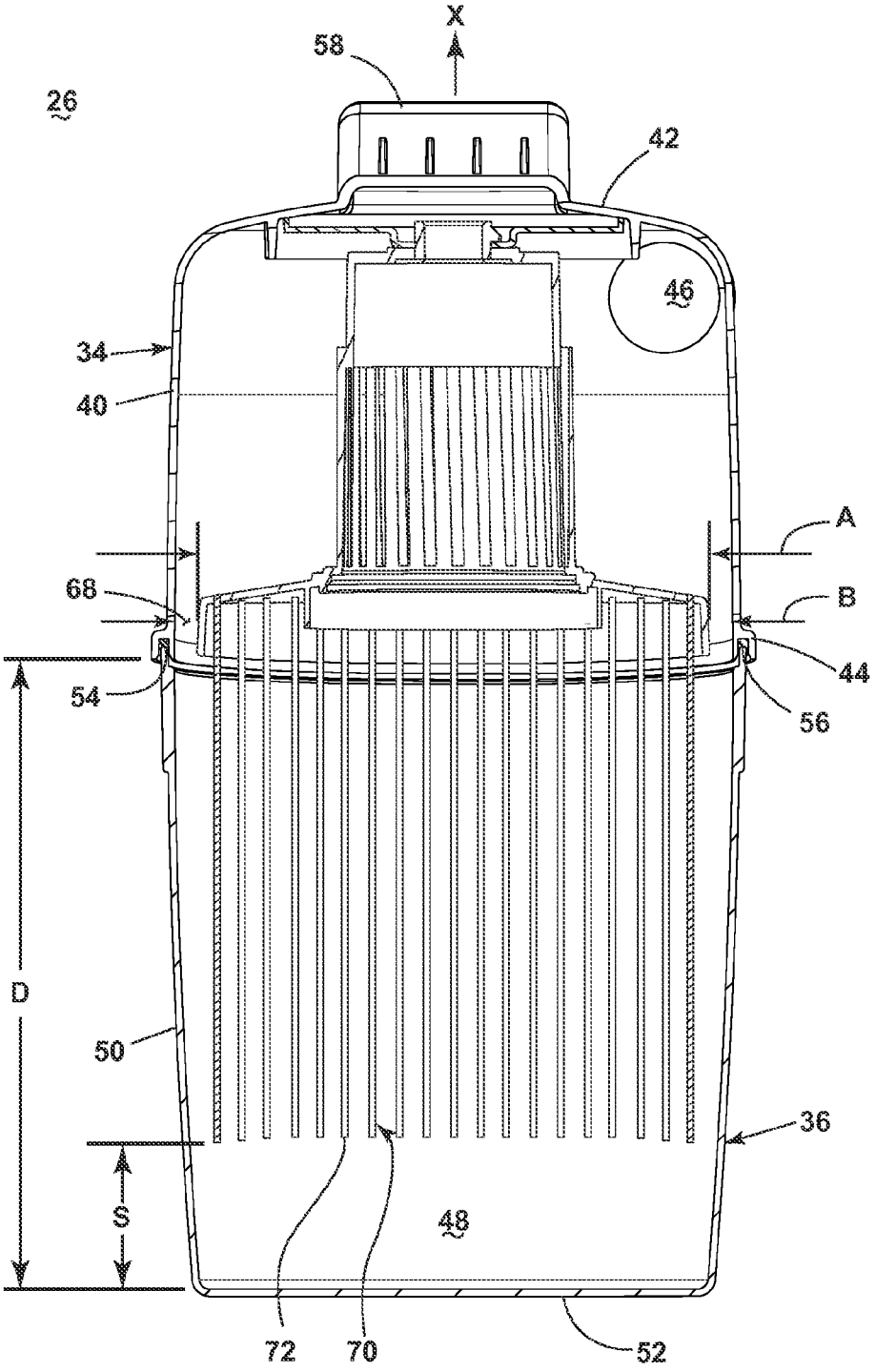
FIG. 2 is a front sectional view through a separation module according to a first embodiment of the invention.
Figure 3:
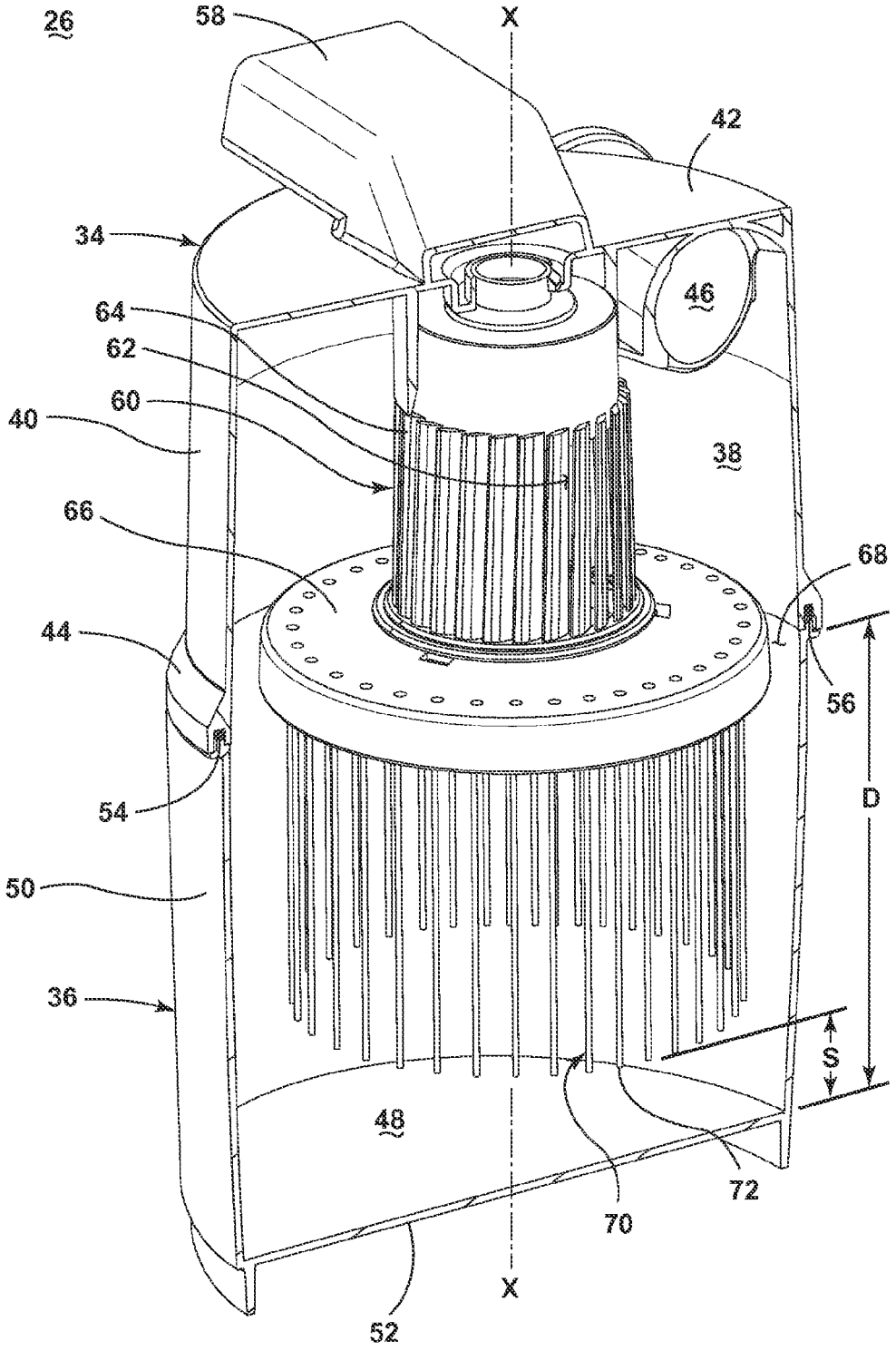
FIG. 3 is a perspective sectional view through a separation module according to a first embodiment of the invention.

FIGS. 2-3 are a front and perspective, respectively, sectional view through the separation module 26 of FIG. 1. The separation module 26 illustrated herein comprises a single-stage cyclone separator 34 for separating contaminants from a dirt-containing working airstream and a dirt cup 36 which receives contaminants separated by the cyclone separator 34. The cyclone separator 34 defines a separation chamber 38 and comprises a side wall 40, a top wall 42, and an open bottom defined by an edge 44. An air inlet 46 to the separation chamber 38 is formed in the side wall 40 and can be defined by an inlet conduit extending outwardly from the side wall 40. While not illustrated, the inlet 46 is in fluid communication with the suction nozzle 30 (FIG. 1).

The dirt cup 36 defines a collection chamber 48, and comprises a side wall 50, a bottom wall 52, and an open top defined by an edge 54 that is selectively joined to the bottom edge 44 of the cyclone separator 34. A gasket 56 can be provided between the edges 44, 54. While the separation chamber 38 and collection chamber 48 are shown herein as being defined by separate housings, it is also contemplated that the separation chamber 38 and collection chamber 48 can be defined by a common or integral housing. In this case, the bottom wall 52 defining the collection chamber 48 can be provided with a dirt door for selectively releasing debris collected therein from the separation module 26, which can be referred to as a "bottom-empty" separation module.

An air outlet 58 from the separation module 26 can be provided in the top wall 42 of the cyclone separator 34. While not illustrated, the outlet 58 is in fluid communication with the suction source in the motor cavity 20 (FIG. 1).

The separation module 26 further comprises a grill assembly 60 positioned within the separation chamber 38, upstream of the outlet 58. The grill assembly 60 can include a grill having a plurality of grill openings 62 through which air may pass. The openings 62 may be defined between spaced vanes or louvers 64, as shown herein, or may be defined by perforations or holes in the side wall of the grill assembly 60. A separator plate 66 can be provided on the grill assembly 60, and can project radially outwardly from a lower end of the grill assembly 60. The separator plate 66 serves to separate the separator chamber 38 from the collection chamber 48, and can define, along with the side wall 40 of the cyclone separator 34, a debris outlet 68 from the separation chamber 38.

The separation module 26 further includes a plurality of debris catching tines 70 which depend downwardly from the separator plate 66. The debris catching tines 70 are configured to prevent debris, such as hair, from wrapping around and blocking or clogging the grill assembly 60. More specifically, the tines 70 can be located on the bottom of the separator plate 66 and extend downwardly into the collection chamber 48 and comprising free terminal ends 72. The tines 70 are oriented vertically, i.e. parallel to a central axis X of the separation module 26, and can comprise thin, stiff rods having a circular cross-section. The tines 70 can be spaced from each other around the periphery of the separation plate 66, and can form a ring-shaped pattern such that each tine 70 is equidistant from the central axis X. The tines 70 can be made from metal or plastic.

The performance of the tines 70 can be dependent on several factors, including the diameter of the tines 70, the spacing between adjacent tines 70, the diameter of the ring-shaped pattern formed by the tines 70 in comparison with the inner diameter of the dirt cup 36, and the length of the tines in comparison to the length of the dirt cup. These dimensions can vary, based on the dimensions of the separation module 26, including the diameter of the separator plate 66, separation chamber 38, and the collection chamber 48, and the length or height of the collection chamber 48. In one example, the diameter of each tine 70 is about 3 mm, with the spacing between adjacent tines being about 12 mm. With these dimensions, the total number of tines 70 can be about 30. For a given tine spacing, the total number of tines can be expressed as a function of the diameter A of the separator plate 66. For example, when the center to center spacing between adjacent tines is around 12 mm, the total number of tines 70 can be expressed as a function of the diameter A of the separator plate 66 in millimeters. More specifically the total number of tines 70 can be approximated by the formula: 0.26(A). However, the diameter and spacing between tines 70, and thus, the total number of tines 70 can vary. For example, the spacing between the tines 70 can vary from approximately 5-100 mm, and the total number of tines 70 can vary from approximately 3-100. The diameter of the ring-shaped pattern formed by the tines 70 can be expressed as a function of the inner diameter B of the dirt cup 36 measured at the top edge 54. More specifically, the diameter of the ring-shaped pattern formed by the tines 70 can be approximated by the formula: 0.70(B), but can range from about 0.5(B) to 0.9(B).

The terminal ends 72 of the tines 70 are spaced from the bottom wall 52 of the collection chamber 48 a distance S. As shown herein, the tines 70 can extend a length of greater than half the distance D between the separator plate 66 and the bottom wall 52 of the collection chamber 48. More specifically, the tines 70 can extend at least ¾ of the distance D between the separator plate 66 and the bottom wall 52 of the collection chamber 48 to maximize the collection of debris, such as hair, on the tines 70.

Other configurations are contemplated, such as tines 70 that can extend about ½ of the distance D between the separator plate 66 and the bottom wall 52 of the collection chamber 48, for example. Ultimately, the length of the tines 70 can vary, depending on the configuration of the separation module 26 and airflow patterns therein or other design constraints, for example. However, if the tines 70 are too short, they will not collect a desirable amount of debris.

Figure 4:
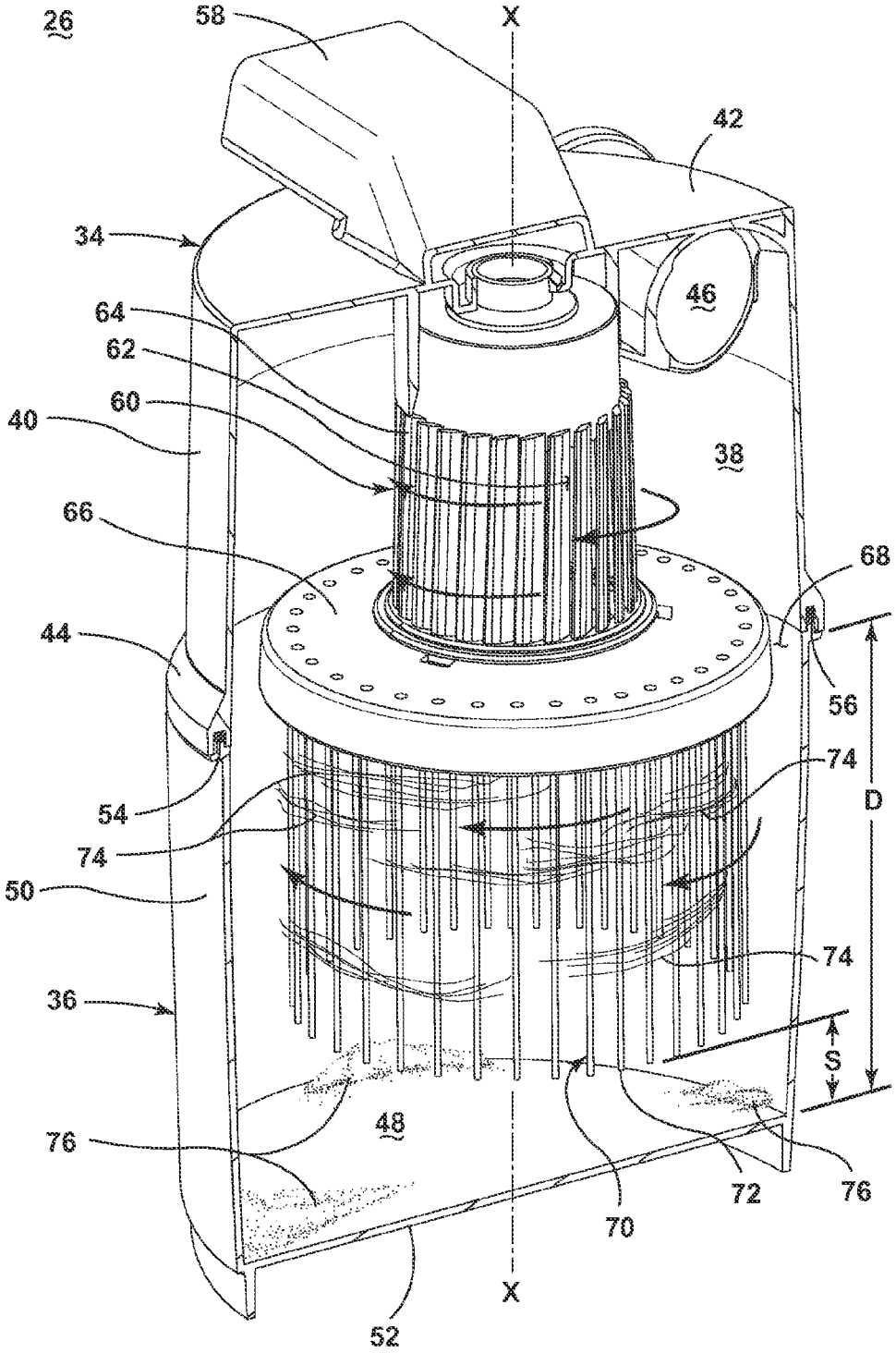
FIG. 4 is a view similar to FIG. 3, illustrating the collection of debris in the separation module during operation.

FIG. 4 is a view similar to FIG. 3, illustrating the collection of dirt, hair, and other debris in the separation module 26 during operation. During operation, string-like or elongated debris 74, such as pieces of hair, fabric fibers, and fuzz, that are entrained within the swirling airflow are caught and retained on the tines 70 for later disposal, while particle-like debris 76, such as dirt, are collected at the bottom of the dirt cup 36 in the collection chamber 48. The elongated debris can be shaken or wiped off the tines 70 when the dirt cup 36 is emptied. The tines 70 effectively prevent elongated debris 74 from wrapping around the grill assembly 60, which can hinder performance by blocking or clogging the grill openings 62 and can further present a nuisance clean-up issue for users.

The tines 70 of the first embodiment can also be used on other types of separation modules 26, including multi-stage or multi-cyclone modules, bottom-empty modules having releasable dirt doors, modules with the air outlet formed in the bottom of the dirt cup, etc. Some non-limiting examples of further embodiments of separation modules with debris catching tines are shown in FIGS. 5-21, and can be used with the vacuum cleaner 10 of FIG. 1.

Figure 5:
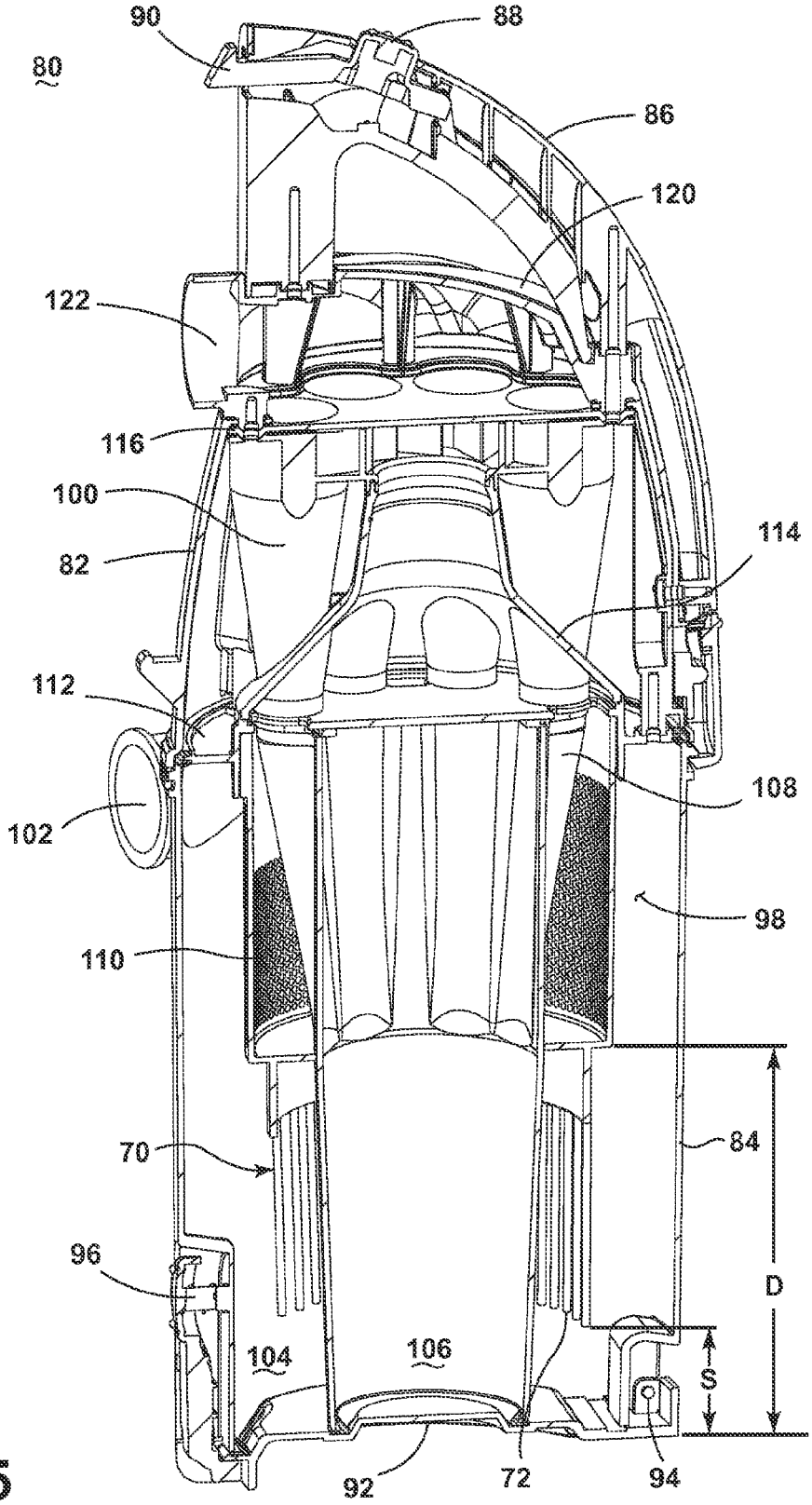
FIG. 5 is a sectional view through a separation module according to a second embodiment of the invention.

FIG. 5 is a sectional view through a separation module 80 according to a second embodiment of the invention. The separation module 80 can be provided on the vacuum cleaner shown in FIG. 1. The separation module 80 comprises an upper casing 82 and a lower casing 84, with a carry handle 86 located on the upper casing 82. The carry handle 86 has an actuator 88 that operates a rotatably mounted and biased upper latch 90 that releasably secures the separation module 80 to the vacuum cleaner 10 (FIG. 1). The separation module 80 further has a pivotally mounted bottom door 92 that is attached to the lower casing 84 by a hinge 94. When the separation module 80 is removed from the vacuum cleaner, the debris collected therein can be emptied by releasing the bottom door 92. A pivoting lever 96 that releasably engages the bottom door 92 for selectively opening the bottom door 92 and emptying the lower casing 84 is provided opposite the hinge 94.

The separation module 80 further comprises a first separation stage comprising a primary separation chamber 98 and a second separation stage comprising multiple parallel secondary separation chambers 100 located downstream of and positioned above the primary separation chamber 98. A tangential working air inlet 102 to the primary separation chamber 98 is formed in the upper side wall of the lower casing 84. The debris separated by the primary separation chamber 98 collects in the bottom of the lower casing 84 in a first collection chamber 104 and the debris separated by the secondary separation chambers 100 collects in the bottom of the lower casing 84 in a second collection chamber 106. The debris from the secondary separation chambers 100 passes from the bottom of the secondary separation chambers 100 to the second collection chamber 106 through chutes 108.

A perforated grill assembly 110 is positioned between the primary separation chamber 98 and the secondary cyclones 100, and is removably mounted to a plate 112 positioned between the upper and lower casings 82, 84. A conduit 114 leads from the interior of the perforated grill assembly 110 to the inlets of the secondary separation chambers 100 and is mounted to the top of the plate 112. An inner cover 116 is mounted on top of the secondary separation chambers 100 and forms an exhaust pathway for each secondary cyclone 100 formed integrally therein. An outer cover 120 is mounted over and spaced from the inner cover 116 to form an exhaust plenum in which air discharged from each secondary cyclone 100 mixes before it exits the separation module 80 through an air outlet 122 integrally formed in the outer cover 120. Optionally, an exhaust filter (not shown) can be placed upstream from the air outlet 122, such as in the exhaust plenum for example, or downstream from the air outlet 122.

The separation module 80 further includes a plurality of debris catching tines 70 which depend downwardly from the grill assembly 110. The tines 70 can be substantially similar to the tines 70 described above for the first embodiment, including having free terminal ends 72. The terminal ends 72 of the tines 70 are spaced from the bottom door 92 of the lower casing 84 a distance S. As shown herein, the tines 70 can extend a length of greater than half the distance D between the lowermost end of the grill assembly 110 and the bottom door 92 closing the collection chambers 104, 106. More specifically, the tines 70 can extend at least ¾ of the distance D between the lowermost end of the grill assembly 110 and the bottom door 92.

Figure 6:
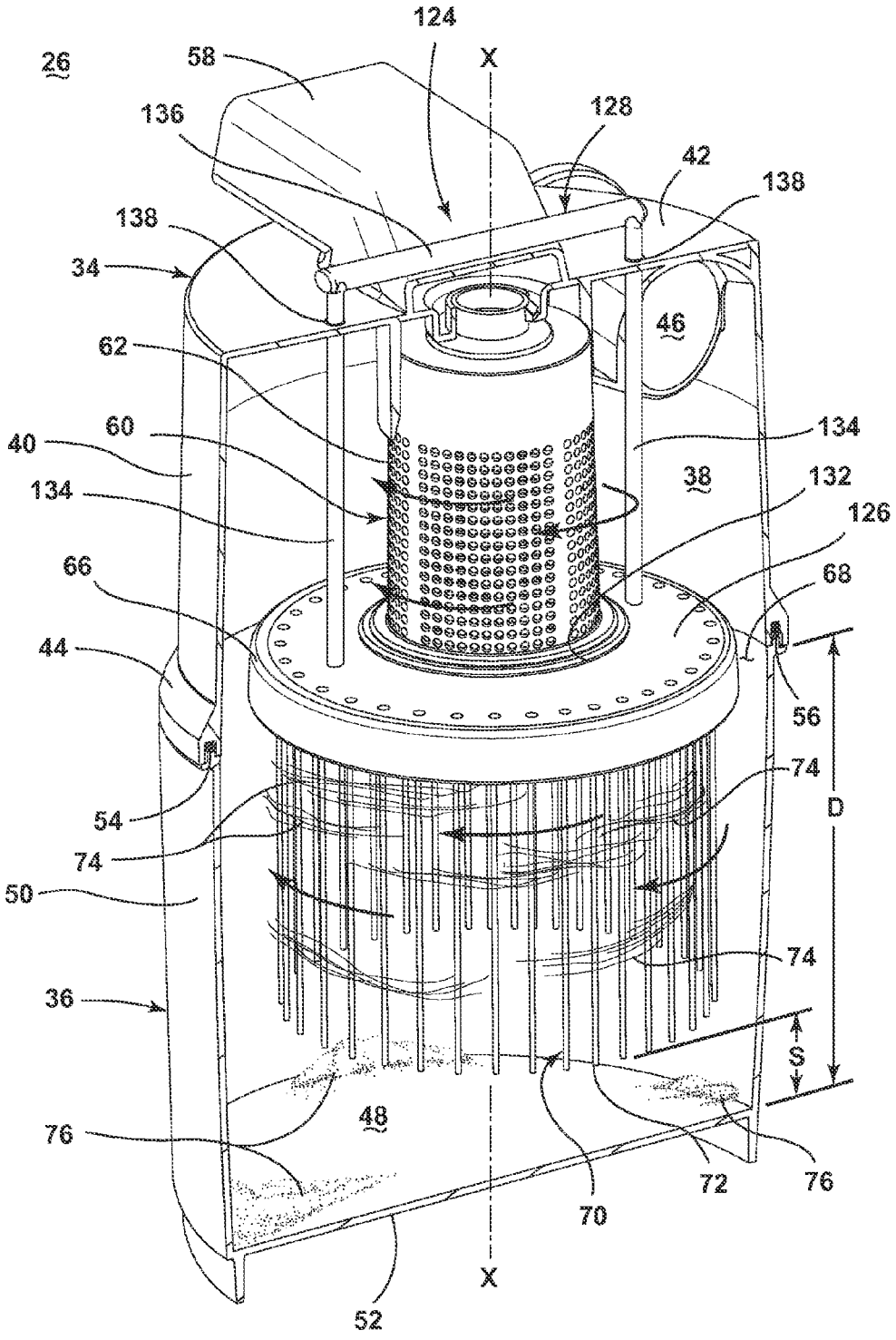
FIG. 6 is a perspective sectional view through a separation module according to a third embodiment of the invention.

FIG. 6 is a perspective sectional view through a separation module 26 according to a third embodiment of the invention. The separation module 26 can be provided on the vacuum cleaner shown in FIG. 1. The third embodiment of the separation module 26 is substantially similar to the first embodiment, but differs from the first embodiment by having a tine cleaner which cleans at least some of the elongated or string-like debris 74 from the tines 70. One embodiment of a tine cleaner is a tine stripper mechanism 124 for stripping the elongated or string-like debris 74 from the tines 70. The tine stripper mechanism 124 comprises a movable tine plate 126 which is provided above the stationary separator plate 66, and a handle 128 attached to the tine plate 126 for selectively raising the tine plate 126 away from the separation plate 66. The tines 70 project from a lower surface of the tine plate 126, and the separate plate 66 has a plurality of slots 130 configured to slidingly receive the tines 70. The tine plate 126 further includes an inner opening 132 providing clearance for the tine plate 126 to move vertically with respect to the grill assembly 60.

The handle 128 includes at least one connecting rod 134 coupled to the upper surface of the tine plate 126, and a hand grip 136 provided on the exterior of the separation module 26 and coupled to the at least one connecting rod 134. As shown herein, two connecting rods 134 are coupled to the tine plate 126 and are spaced from each other on opposite sides of the grill assembly 60. The connecting rods 134 extend upwardly through the separation chamber 38 and pass through openings 138 provided in the top wall 42 of the cyclone separator 34. Optionally, seals (not shown) can be provided around the openings 138 to prevent air leaks through gaps between the openings 138 and connecting rods 134. The hand grip 136 is coupled to both of the connecting rods 134 exterior of the cyclone separator 34.

Figure 7:
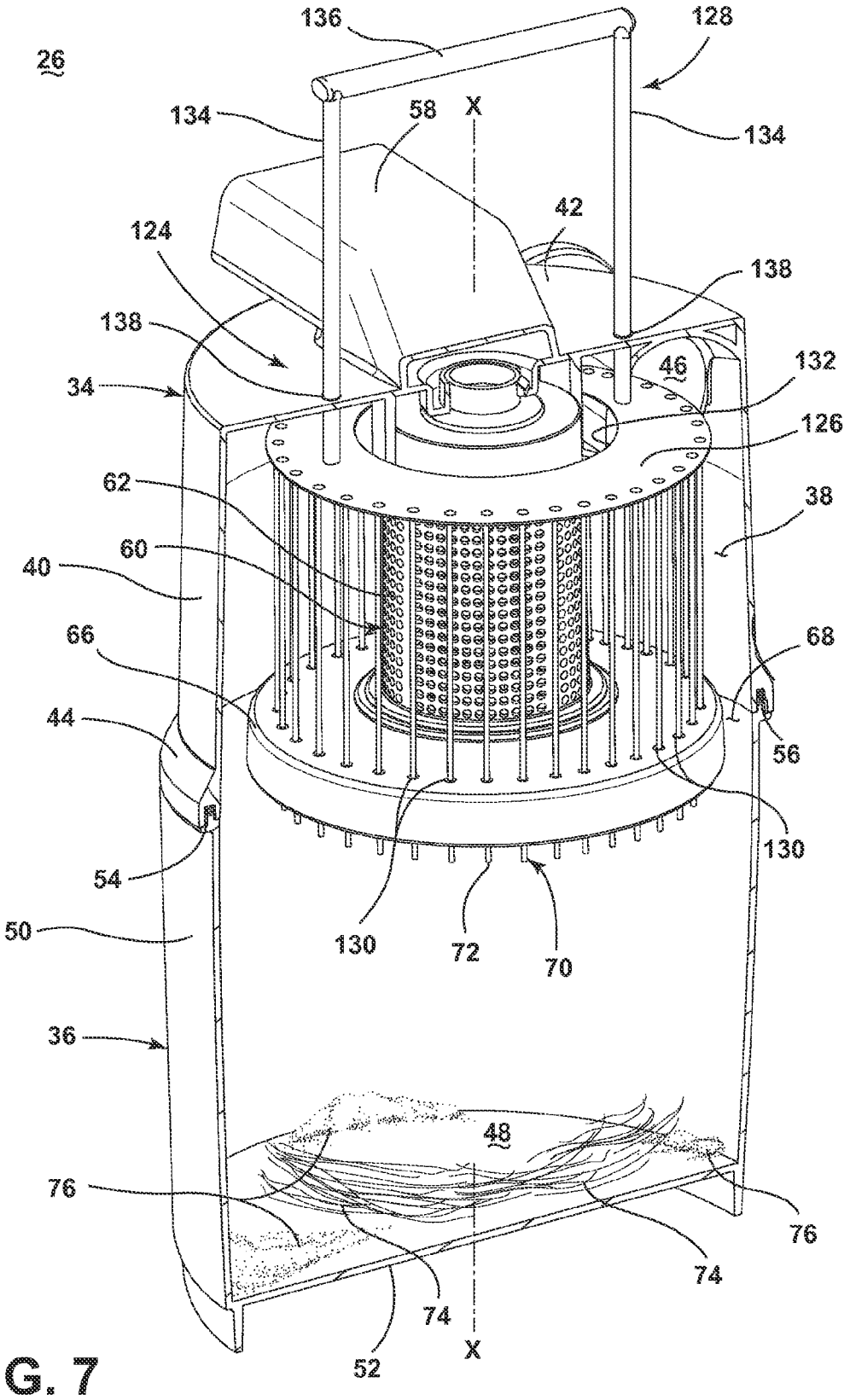
FIG. 7 is a view similar to FIG. 6, illustrating the collection of debris in the separation module during operation.

FIG. 7 is a view similar to FIG. 6, illustrating the collection of dirt, hair, and other debris in the separation module during operation. After a cleaning operation, elongated or string-like debris 74 are collected on the tines 70, while particle-like debris 76 are collected at the bottom of the dirt cup 36 in the collection chamber 48. The tine stripper mechanism 124 is operated in order to release the elongated or string-like debris 74 from the tines 70 into the dirt cup 36. A user grips the hand grip 136 and pulls upwardly on the handle 128 to raise the tine plate 126 and the tines 70 away from the separator plate 66. There is a tight clearance between each tine 70 and its associated slot 130, so that the tine 70 can slide through the slot 130, but that any elongated or string-like debris 74 on the tine 70 cannot pass through the slot 130. The elongated or string-like debris 74 are stripped off tines 70, and fall into the collection chamber 48 of the dirt cup 36. In this way, all collected debris (elongated or string-like debris 74 and particle-like debris 76) can be emptied simultaneously when the dirt cup 34 is removed from the vacuum cleaner 10 and inverted over a waste receptacle.

The entire separation module 26 can be removed from the vacuum cleaner 10 prior to operating the tine stripper mechanism 124. Alternatively, the vacuum cleaner 10 can be configured to allow sufficient clearance for raising the handle 128, such that the user can operate the tine stripper mechanism 124 with the separation module 26 still installed on the vacuum cleaner 10, and then remove just the dirt cup 36 for emptying.

Figure 8:
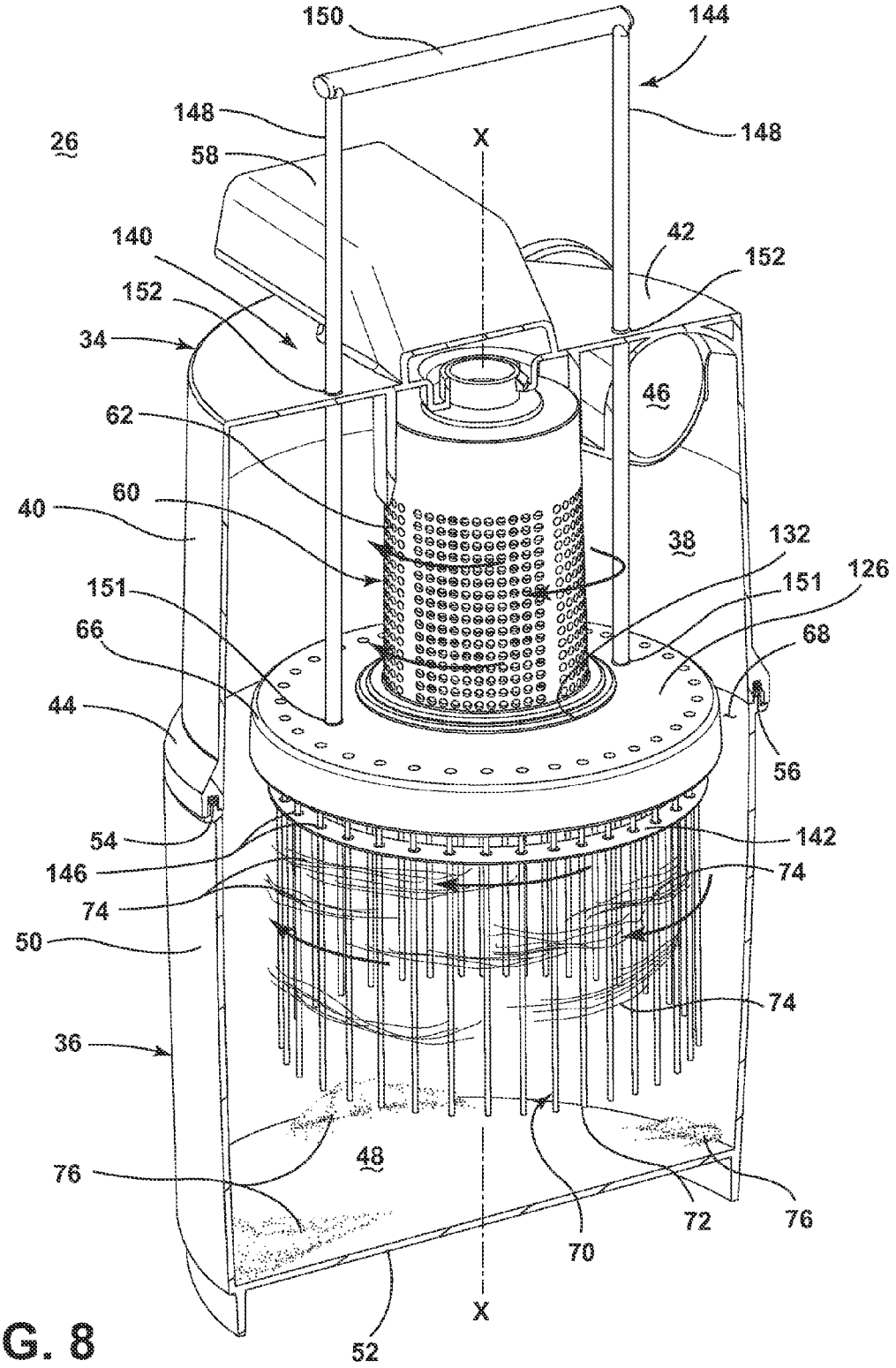
FIG. 8 is a perspective sectional view through a separation module according to a fourth embodiment of the invention.

FIG. 8 is a perspective sectional view through a separation module 26 according to a fourth embodiment of the invention. The separation module 26 can be provided on the vacuum cleaner shown in FIG. 1. The fourth embodiment of the separation module 26 differs from the third embodiment by having a modified version of a tine stripper mechanism 140 for stripping the elongated or string-like debris 74 from the tines 70. The tine stripper mechanism 140 comprises a movable stripper plate 142 which is provided below the stationary separator plate 66, and a handle 144 attached to the stripper plate 142 for selectively lowering the stripper plate 142 away from the separation plate 66. The tines 70 project from a lower surface of the separation plate 66, and the stripper plate 142 has a plurality of slots 146 configured to slidingly receive the tines 70.

The handle 144 includes at least one connecting rod 148 coupled to the stripper plate 142, and a hand grip 150 provided on the exterior of the separation module 26 and coupled to the at least one connecting rod 148. As shown herein, two connecting rods 148 are coupled to the stripper plate 142 and are spaced from each other on opposite sides of the grill assembly 60. The connecting rods 148 extend upwardly through the separation chamber 38 and pass through openings 151 provided in the separator plate 66 and openings 152 provided in the top wall 42 of the cyclone separator 34. Optionally, seals (not shown) can be provided around the openings 152 to prevent air leaks through gaps between the openings 152 and connecting rods 148. The hand grip 150 is coupled to both of the connecting rods 148 exterior of the cyclone separator 34.

Figure 9:
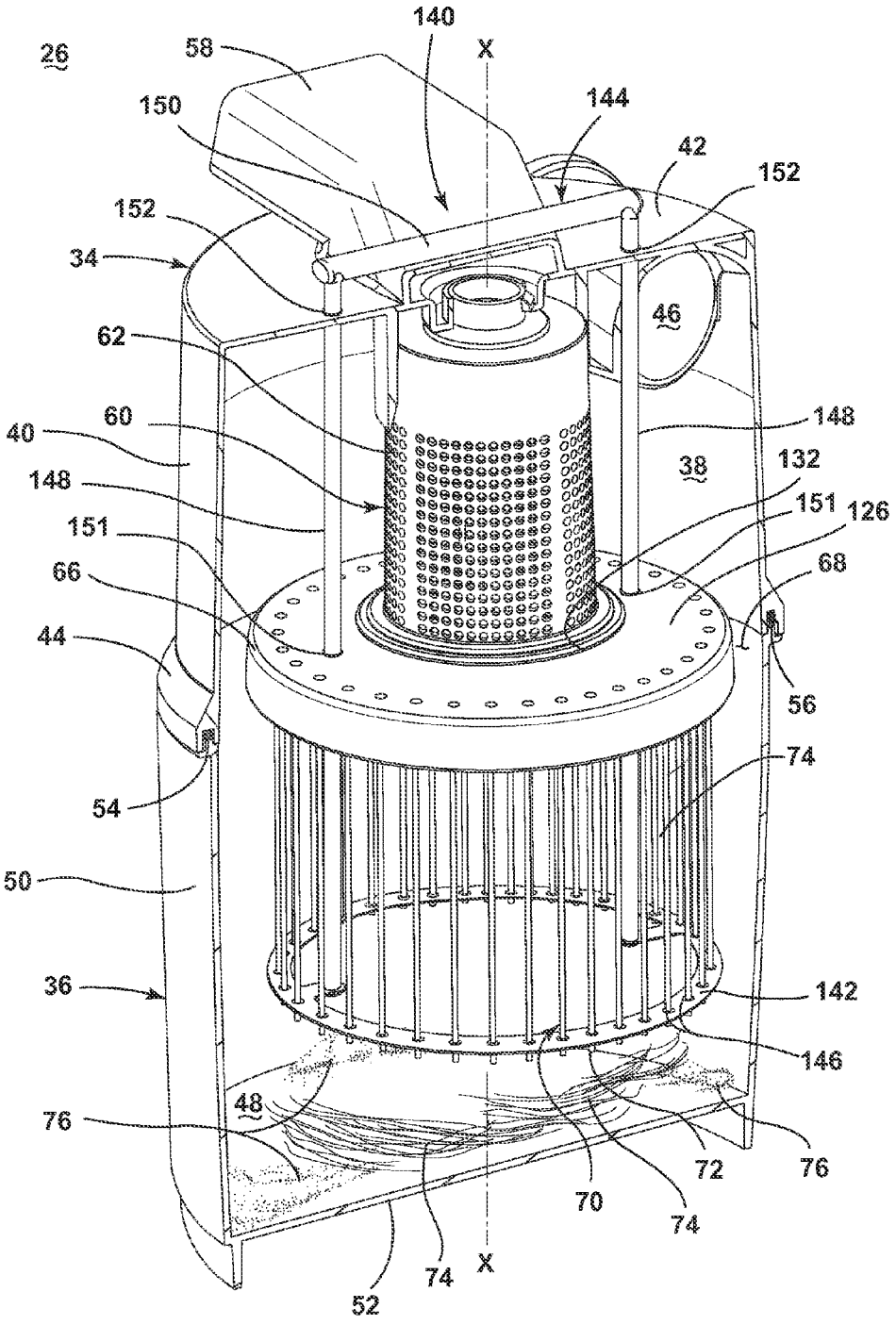
FIG. 9 is a view similar to FIG. 8, illustrating the collection of debris in the separation module during operation.

FIG. 9 is a view similar to FIG. 8, illustrating the collection of dirt, hair, and other debris in the separation module during operation. After a cleaning operation, elongated or string-like debris 74 are collected on the tines 70, while particle-like debris 76 are collected at the bottom of the dirt cup 36 in the collection chamber 48. The tine stripper mechanism 140 is operated in order to release the elongated or string-like debris 74 from the tines 70 into the dirt cup 36. A user grips the hand grip 150 and pushes downwardly on the handle 144 to lower the stripper plate 142 over the tines 70, away from the separator plate 66. There is a tight clearance between each tine 70 and its associated slot 146, so that the slot 146 can slide over the tine 70, but that any elongated or string-like debris 74 on the tine 70 cannot pass through the slot 146. The elongated or string-like debris 74 are stripped off tines 70, and fall into the collection chamber 48 of the dirt cup 36. In this way, all collected debris (elongated or string-like debris 74 and particle-like debris 76) can be emptied simultaneously when the dirt cup 34 is removed from the vacuum cleaner 10 and inverted over a waste receptacle.

The entire separation module 26 can be removed from the vacuum cleaner 10 prior to operating the tine stripper mechanism 140. Alternatively, the vacuum cleaner 10 can be configured to allow sufficient clearance for the raised handle 144, such that the user can operate the tine stripper mechanism 140 with the separation module 26 still installed on the vacuum cleaner 10, and then remove just the dirt cup 36 for emptying.

Figure 10:
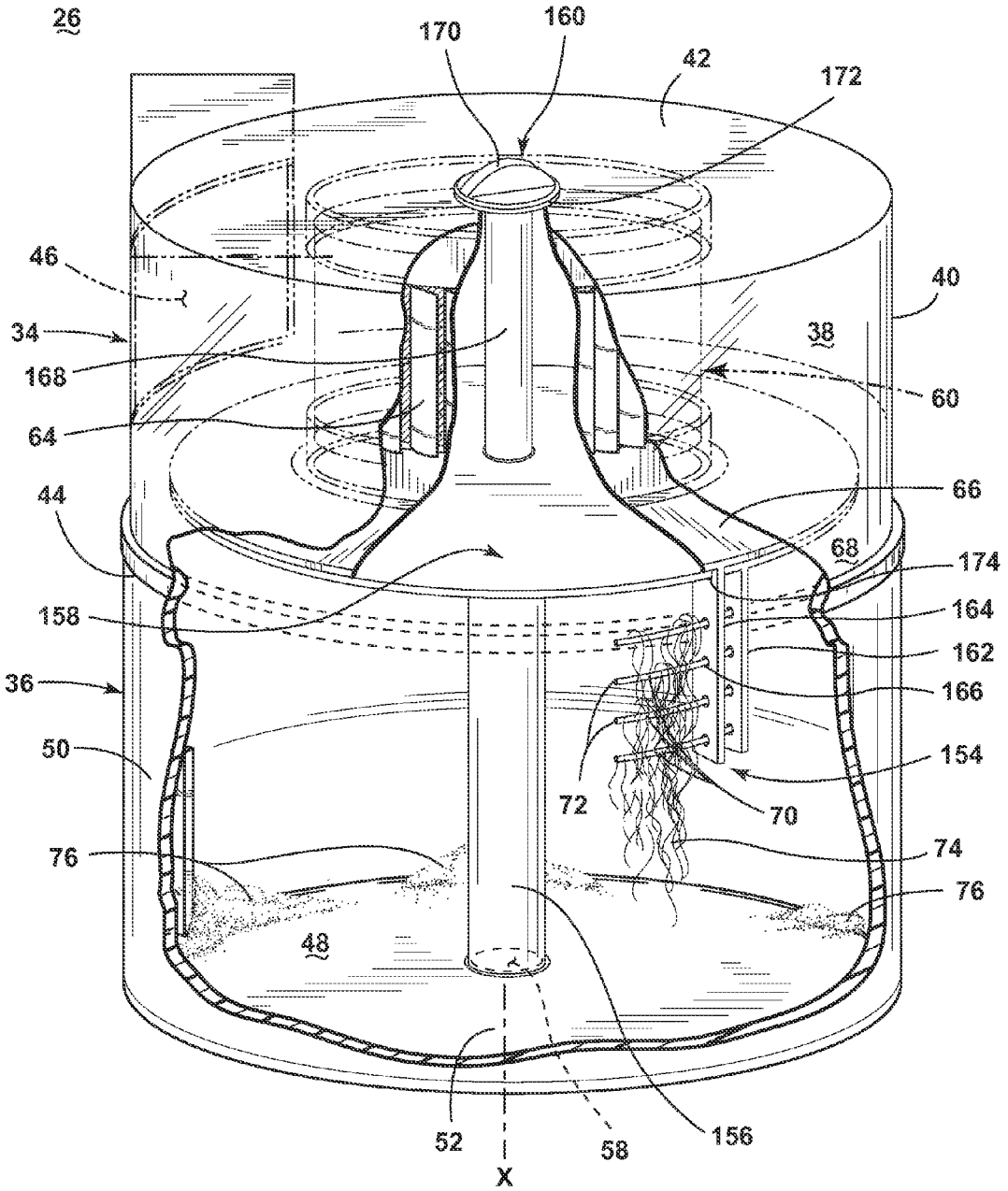
FIG. 10 is a sectional view through a separation module according to a fifth embodiment of the invention.

FIG. 10 is a sectional view through a separation module 26 according to a fifth embodiment of the invention. The separation module 26 can be provided on the vacuum cleaner shown in FIG. 1. The fifth embodiment of the separation module 26 is substantially similar to the first embodiment, but differs from the first embodiment by having horizontally-oriented tines 70, and a tine stripper mechanism 154 for stripping the elongated or string-like debris 74 from the tines 70. The separation module 26 of the fifth embodiment also has the air outlet 58 provided in the bottom wall 52 of the dirt cup 36. An outlet conduit 156 extends through the separation module 26, from the grill assembly 60 to the air outlet 58.

The tine stripper mechanism 154 comprises a movable plate in the shape of a ring 158 which is provided below the stationary separator plate 66, and a handle 160 attached to the ring 158 for selectively rotating the ring 158 relative to the separation plate 66. One or more tine plates 162 project(s) from a lower surface of the ring 158, and the tines 70 extend from the tine plate 162 to terminal ends 72. The tines 70 extend in a generally horizontal plane from the plate 162, i.e. perpendicular to the central axis X of the separation module 26, and can be curved such that the tines 70 bend around the central axis X of the separation module 26. The tines 70 can be curved such that it there is a constant distance between the tine 70 and the central axis X. On each tine plate 162, a plurality of tines 70 are provided, and can be spaced vertically from each other. A corresponding slotted plate 164 projects from the lower surface of the separate plate 66 and has a plurality of tine slots 166 configured to slidingly receive the tines 70 on the associated tine plate 162. While only one tine plate 162 and slotted plate 164 are shown in the figures, the ring 158 and separator plate 66 can be provided with multiple sets of tine plates 162 and slotted plates 164, respectively.

The handle 160 includes at least one connecting shaft 168 coupled to the ring 158, and a knob 170 provided on the exterior of the separation module 26 and coupled to the at least one connecting shaft 168. The connecting shaft 168 extends upwardly through the separation chamber 38 and passes through an opening 172 provided in the top wall 42 of the cyclone separator 34. Optionally a seal (not shown) can be provided around the opening 172 to prevent air leaks through gaps between the opening 172 and connecting shaft 168. The knob 170 is coupled to the connecting shaft 168 exteriorly of the cyclone separator 34.

Figure 11:
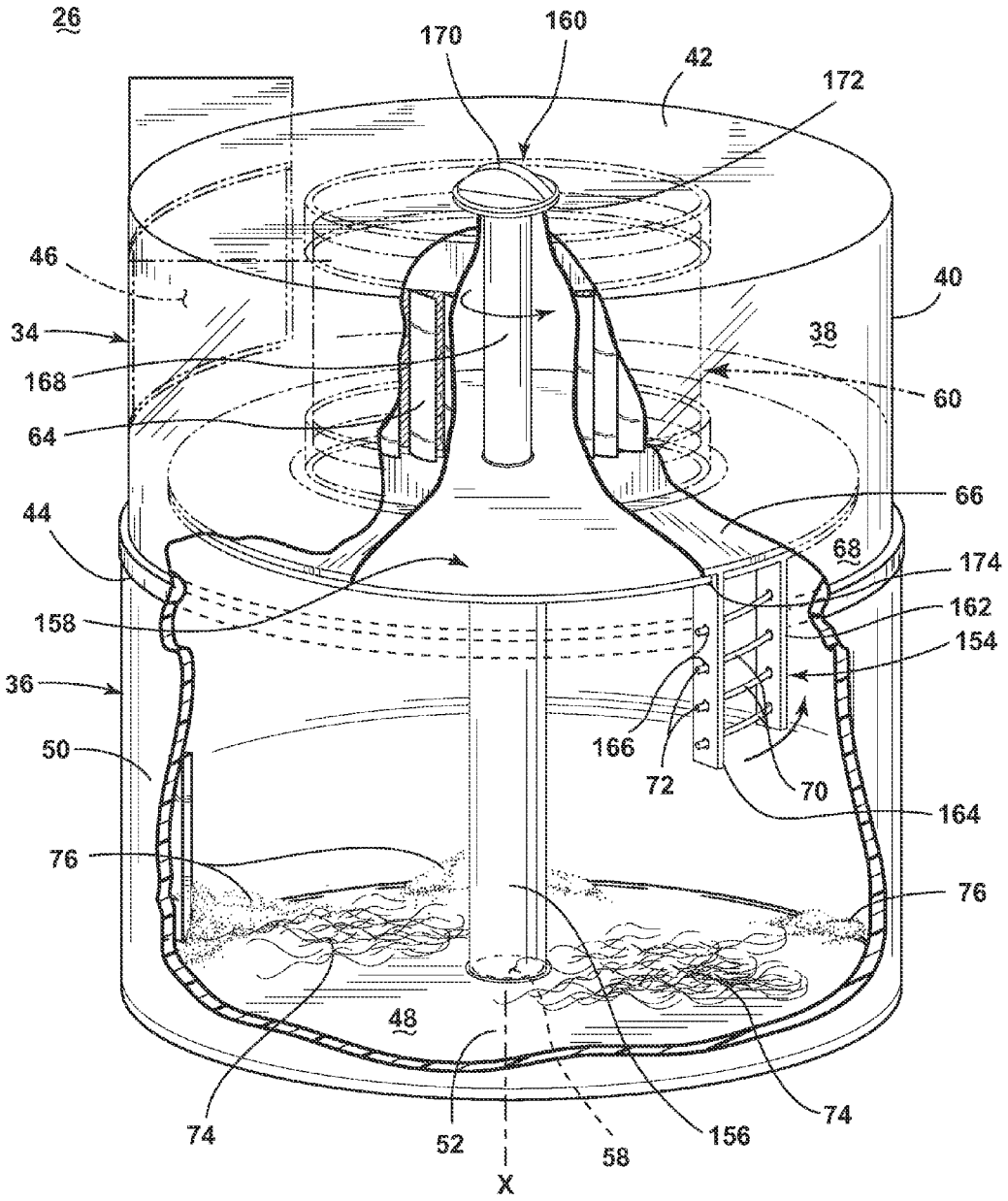
FIG. 11 is a view similar to FIG. 10, illustrating the collection of debris in the separation module during operation.

FIG. 11 is a view similar to FIG. 10, illustrating the collection of dirt, hair, and other debris in the separation module during operation. After a cleaning operation, elongated or string-like debris 74 are collected on the tines 70, while particle-like debris 76 are collected at the bottom of the dirt cup 36 in the collection chamber 48. The tine stripper mechanism 154 is operated in order to release the elongated or string-like debris 74 from the tines 70 into the dirt cup 36. A user grips the knob 170 and rotates the shaft 168 to rotate the ring 158 relative to the separator plate 66. This moves the tines 70 away from the slotted plate 164. There is a tight clearance between each tine 70 and its associated slot 166, so that the tine 70 can slide through the slot 166, but that any elongated or string-like debris 74 on the tine 70 cannot pass through the slot 166. The elongated or string-like debris 74 are stripped off tines 70, and fall into the collection chamber 48 of the dirt cup 36. In this way, all collected debris (elongated or string-like debris 74 and particle-like debris 76) can be emptied simultaneously when the dirt cup 34 is removed from the vacuum cleaner 10 and inverted over a waste receptacle. During stripping, the slotted plate 164 remains stationary, and can include a ring slot 174 for allowing the ring 158 to pass through the slotted plate 164. In another embodiment, the tine plate 162 can remain stationary while the slotted plate 164 is moved over the tines 70.

The entire separation module 26 can be removed from the vacuum cleaner 10 prior to operating the tine stripper mechanism 154. Alternatively, the vacuum cleaner 10 can be configured to allow sufficient clearance for rotating the knob 170, such that the user can operate the tine stripper mechanism 154 with the separation module 26 still installed on the vacuum cleaner 10, and then remove just the dirt cup 36 for emptying.

Figure 12:
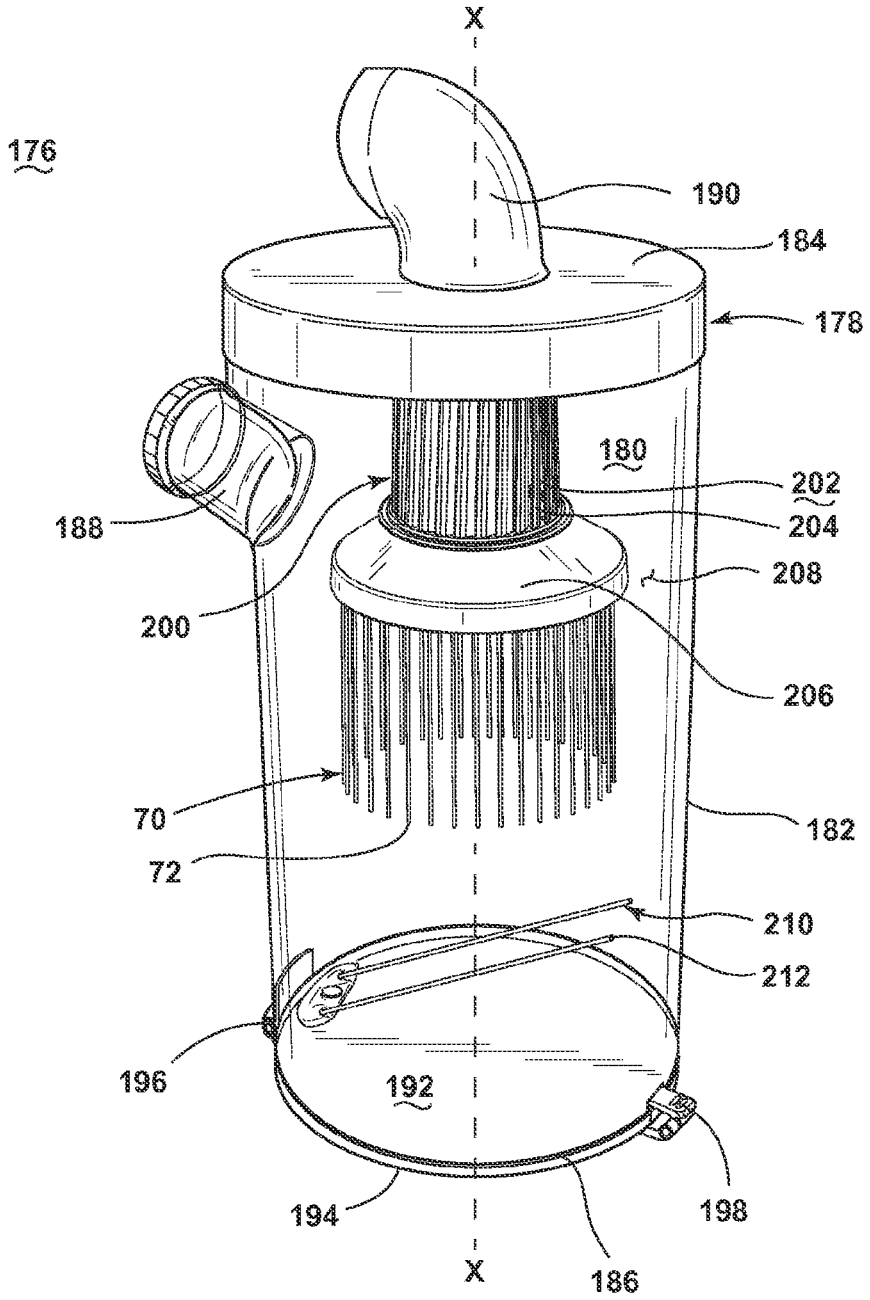
FIG. 12 is a perspective view of a separation module according to a sixth embodiment of the invention.

FIG. 12 is a perspective view of a separation module 176 according to a sixth embodiment of the invention. The separation module 176 can be provided on the vacuum cleaner shown in FIG. 1. The separation module 176 comprises a housing 178 defining a single-stage separation chamber 180 for separating contaminants from a dirt-containing working airstream. The housing 178 includes a side wall 182, a top wall 184, and an open bottom defined by an edge 186. An air inlet 188 to the separation chamber 180 is formed in the side wall 182 and can be defined by an inlet conduit extending outwardly from the side wall 182. While not illustrated, the air inlet 188 is in fluid communication with the suction nozzle 30 (FIG. 1). An air outlet 190 from the separation module 176 can be provided in the top wall 184 of the housing 178. While not illustrated, the air outlet 190 is in fluid communication with the suction source in the motor cavity 20 (FIG. 1). The debris separated in the separation chamber 180 collects in the bottom of the housing 178 in a collection chamber 192 defined therein.

The housing 178 further has a pivotally mounted bottom door 194 that is attached to the open bottom edge 186 of the housing 178 by a hinge 196, the door 194 defining the bottom of the collection chamber 192. When the separation module 176 is removed from the vacuum cleaner, the debris collected in the collection chamber 192 can be emptied by releasing the bottom door 194. A pivoting lever 198 that releasably engages the door 194 for selectively opening the door 194 and emptying the housing 178 is provided opposite the hinge 196.

The separation module 176 further comprises a grill assembly 200 positioned within the separation chamber 180, upstream of the air outlet 190. The grill assembly 200 can include a grill having a plurality of grill openings 202 through which air may pass. The openings 202 may be defined between spaced vanes or louvers 204, as shown herein, or may be defined by perforations or holes in the side wall of the grill assembly 200. A separator plate 206 can be provided on the grill assembly 200, and can project radially outwardly from a lower end of the grill assembly 200. The separator plate 206 serves to separate the separator chamber 180 from the collection chamber 192, and can define, along with the side wall 182 of the housing 178, a debris outlet 208 from the separation chamber 180.

The separation module 176 further includes a plurality of debris catching tines 70 which depend downwardly from the grill assembly 200 and extend downwardly into the collection chamber 192. The tines 70 can be substantially similar to the tines 70 described above for the first embodiment, including having free terminal ends 72. The terminal ends 72 of the tines 70 are spaced from the bottom door 194 of the housing 178. The tines 70 are oriented vertically, i.e. parallel to a central axis X of the separation module 176.

In addition to the vertical tines 70, the separation module 176 further includes a second set of debris catching tines 210 that are provided on the bottom door 194 of the housing 178. The debris catching tines 210 are configured to collect elongated debris 74, such as hair, in the collection chamber 192. More specifically, the tines 210 can be located on the bottom door 194 and extend upwardly into the collection chamber 192 to free terminal ends 212, which are below the separation chamber 180. The tines 210 can be oriented at an acute angle to the door 194, i.e. non-parallel to the inner surface of the door 194, and can comprise thin rods having a circular cross-section. In one example, the diameter of the tines 210 is about 3 mm. The tines 210 can be spaced from each other on the inner surface of the door 194. The tines 210 can be made from metal or plastic.

In addition to collecting debris, the angled tines 210 can have a second function of acting as a tine stripper mechanism for stripping the elongated or string-like debris 74 from the tines 70. The angle and length of the tines 210 can be configured such that the terminal ends 212 of the tines 210 intersect elongated debris 74 collected on the vertical tines 70. When the door 194 is opened to empty debris, the accompanying movement of the angled tines 210 helps to pull or strip off the debris 74 on the vertical tines 70.

The tines 70, 212 themselves do not have to intersect in order for the angled tines 212 to act as a tine stripper mechanism, as shown in the illustrated embodiment. In another configuration, the angled tines 210 can at least partially intersect the vertical tines 70. It is also noted that the arrangement of tines 70, 212 of the sixth embodiment can also be used on other types of separation modules, including multi-stage or multi-cyclone modules.

Figure 13:
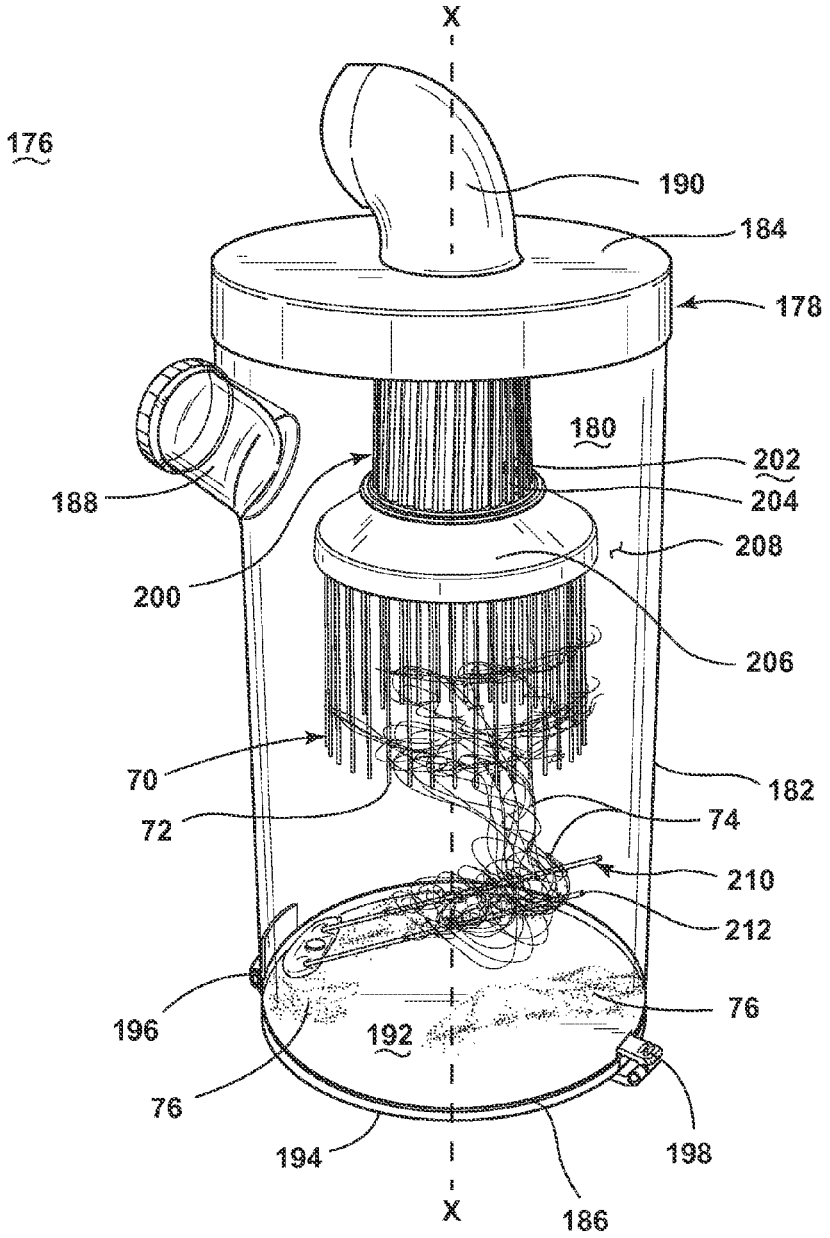
FIG. 13 is a view similar to FIG. 12, illustrating the collection of debris in the separation module during operation.
Figure 14:
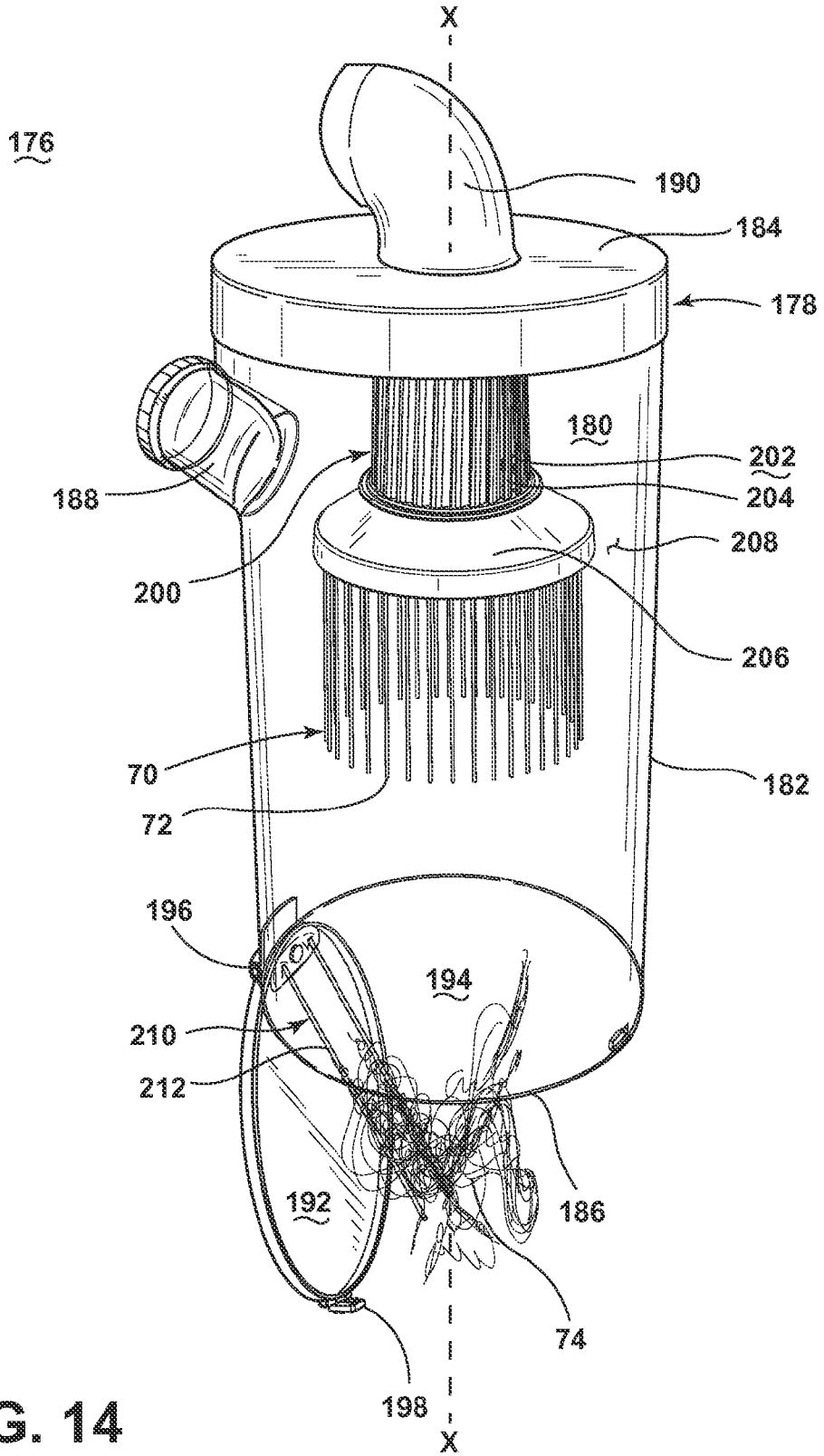
FIG. 14 is a view similar to FIG. 13, illustrating the emptying of debris in the separation module during operation.

FIGS. 13-14 are views similar to FIG. 12, illustrating the collection of debris in the separation module 176 during operation and the subsequent emptying of the collected debris. During operation, string-like or elongated debris 74, such as pieces of hair, fabric fibers, and fuzz, that are entrained within the swirling airflow are caught and retained on the tines 70, 210 for later disposal, while particle-like debris 76, such as dirt, are collected at the bottom of the collection chamber 192. Elongated debris 74 may initially collect on the angled tines 210, and then on the vertical tines 70, after which there may be some intertwining of the collected debris 74 between the tines 70, 212. To empty the collection chamber 192, the door 194 is opened, as shown in FIG. 14, and particle-like debris 76 falls out of the open bottom of the housing 178. At least some of the elongated debris 74 may also fall out of the open bottom of the housing 178. As the door 194 opens, the angled tines 210 intersecting the elongated debris 74 collected on the vertical tines 70 can pull or strip off the debris 74 on the vertical tines 70. The intertwining of the collected debris 74 between the tines 70, 212 may also help pull or strip off the debris 74 on the vertical tines 70, even without a direct intersection between the angled tines 210 and the debris 74 on the vertical tines 70. When the door is fully open, gravity and the orientation of the angled tines 210 helps the debris 74 on the angled tines 210 fall off. If needed, the elongated debris 76 also can be shaken or manually wiped off the tines 70, 210 when the door 194 is open.

FIGS. 15-21 illustrate a multi-cyclone separation module 214 according to a seventh embodiment of the invention, which can be provided on the vacuum cleaner of FIG. 1 and configured for removable mounting therewith. The separation module 214 can be substantially similar to separation module 176 shown in FIGS. 12-14, except that separation module 214 incorporates a secondary separation stage for separating debris from the working airstream after it passes through a primary separation stage. Additionally, the multi-cyclone separation module 214 incorporates both vertical tines 70 and angled tines 210 for collecting elongated or string-like debris. Because certain aspects of the tine configuration differ slightly from the previous embodiments, the forthcoming description will focus only on salient differences to the extent the tine configuration of the seventh embodiment differs from the configuration disclosed in previous embodiments.

Figure 15:
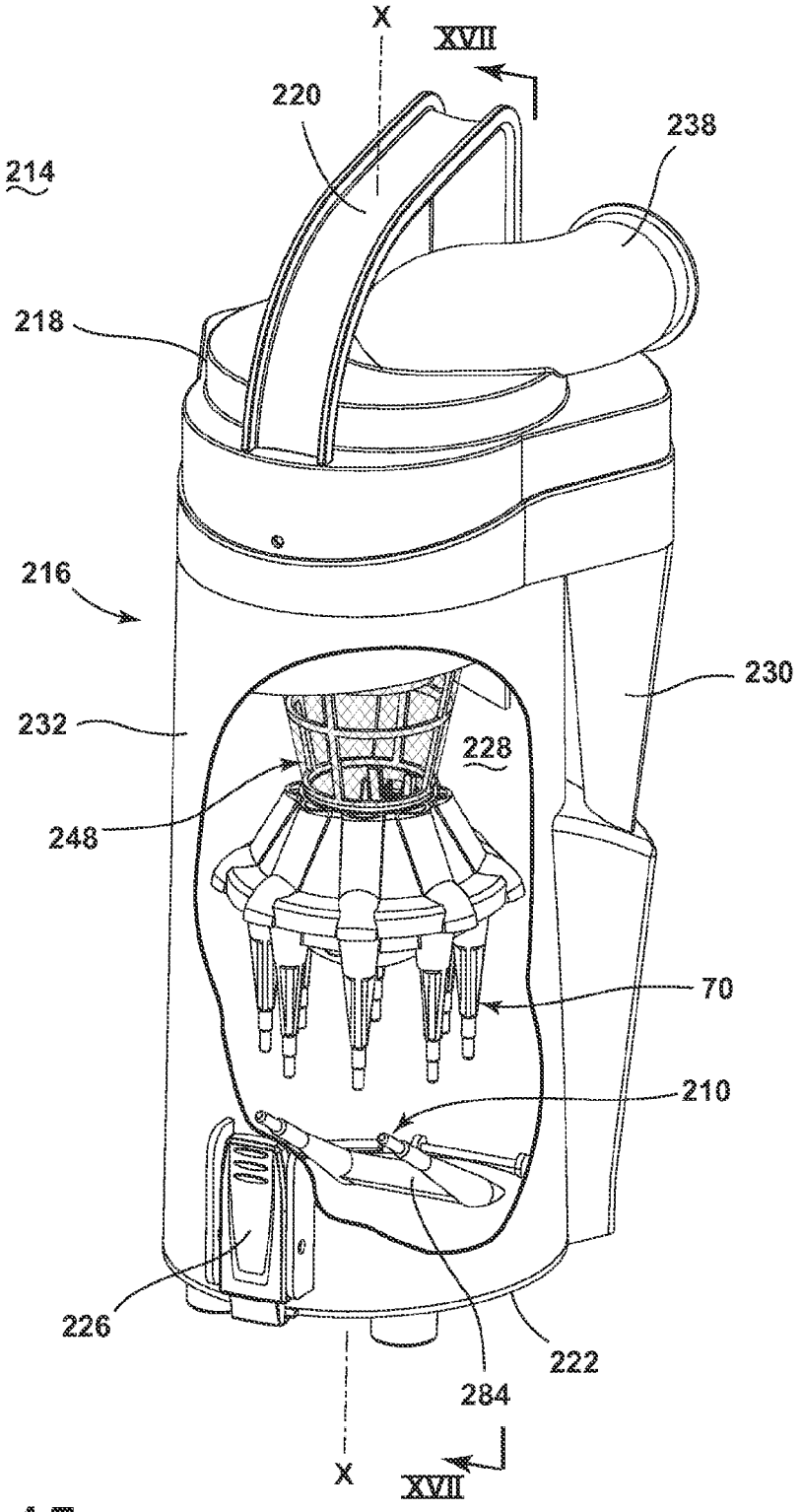
FIG. 15 is a front perspective view of a separation module according to a seventh embodiment of the invention, with a portion of the separation module cut away to show some interior components.
Figure 16:
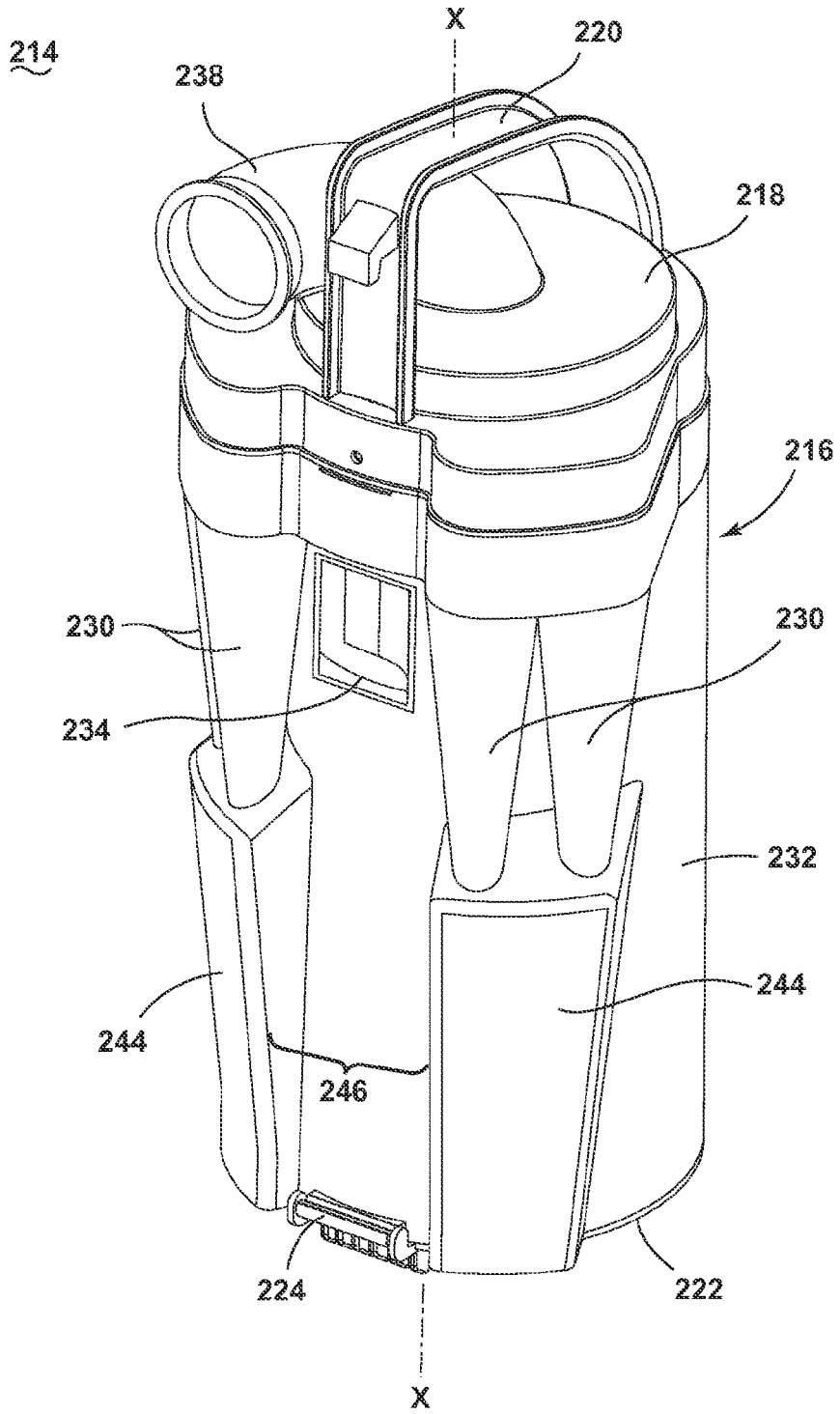
FIG. 16 is a rear perspective view of the separation module from FIG. 15.

Referring to FIGS. 15-16, the multi-cyclone separation module 214 comprises a housing 216 with an outer cover 218 having a carry handle 220 located on an upper portion of the housing 216. While not shown, the carry handle 220 can carry a latch that releasably secures the separation module 214 to the vacuum cleaner 10 (FIG. 1), similar to the latch disclosed in FIG. 5. The separation module 214 further has a pivotally mounted bottom door 222 that is attached to the lower end of the housing 216 by a hinge 224. When the separation module 214 is removed from the vacuum cleaner, the debris collected therein can be emptied by releasing the bottom door 222. A pivoting lever 226 that releasably engages the bottom door 222 for selectively opening the bottom door 222 and emptying the housing 216 is provided opposite the hinge 224.

The housing 216 defines a primary separation stage with a primary separation chamber 228, and a secondary separation stage with a plurality of secondary cyclone separators 230. The primary separation chamber 228 is defined by a generally cylindrical primary separator sidewall 232 of the housing 216 which extends generally along a central axis X of the module 214. A working air inlet 234 to the primary separation chamber 228 is formed in an upper portion of the sidewall 232 and communicates with a helical air inlet passage leading to the primary separation chamber 228. The air inlet 234 is in fluid communication with the suction nozzle 30 (FIG. 1) when the separation module 214 is mounted to the vacuum cleaner 10.

Figure 17:
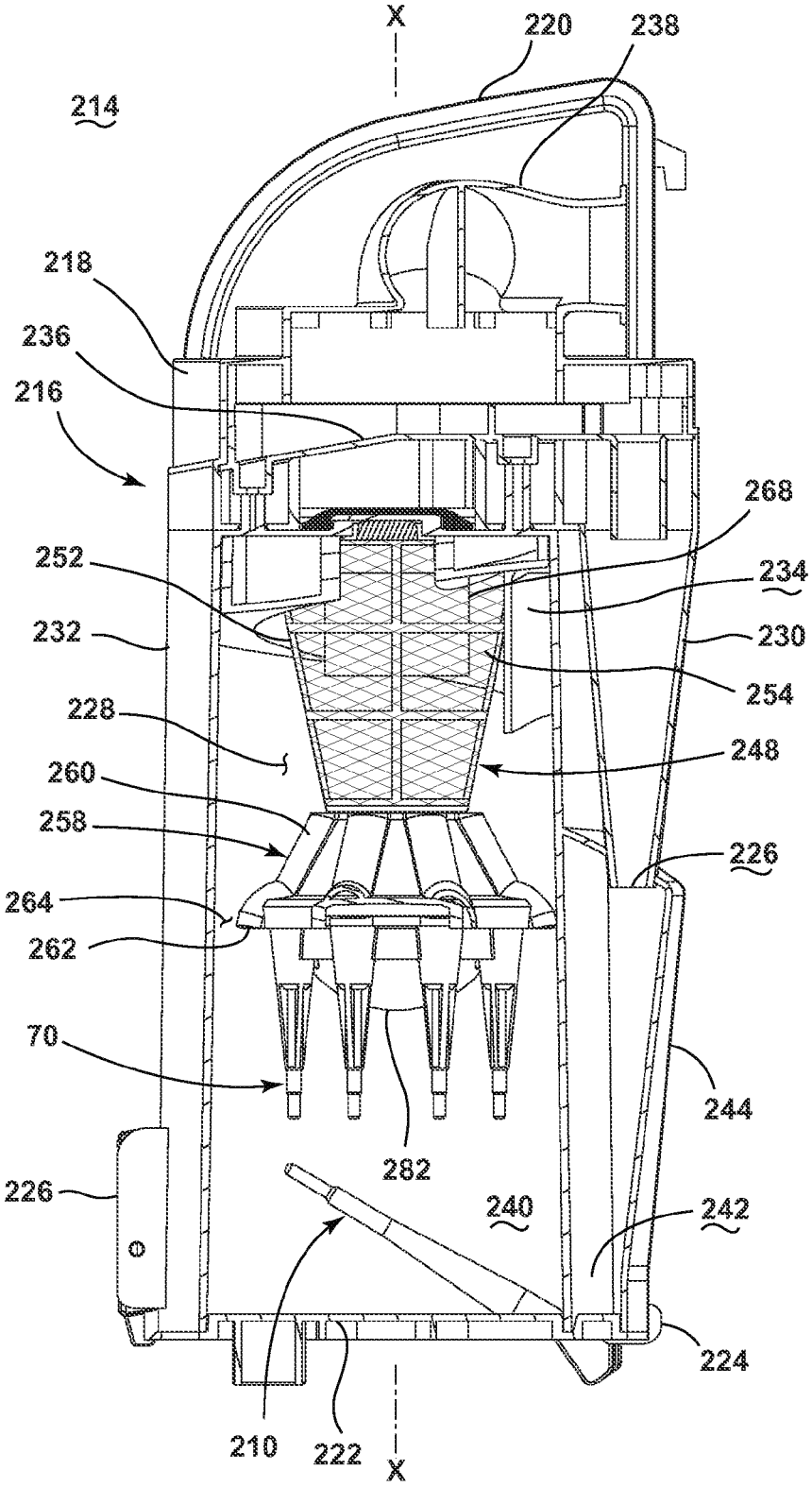
FIG. 17 is a sectional view of the separation module taken through line XVII-XVII of FIG. 15.

FIG. 17 is a cross-sectional view through line XVII-XVII of FIG. 15. An inner cover 236 is mounted on top of the secondary cyclones 230 and forms at least a portion of an exhaust pathway for each secondary cyclone 230. The outer cover 218 is mounted over and spaced from the inner cover 236 to form an exhaust plenum in which air discharged from each secondary cyclone 230 mixes before it exits the separation module 214 through an air outlet 238 integrally formed in the outer cover 218. Optionally, an exhaust filter (not shown) can be placed upstream from the air outlet 238, such as in the exhaust plenum for example, or downstream from the air outlet 238.

Referring to FIGS. 16-17, debris that is separated by the primary separation chamber 228 collects at the bottom of the sidewall 232 in a first collection chamber 240. Debris separated by the secondary cyclone separators 230 collects in one or more second collection chambers 242 defined by one or more bumped out walls 244 on the perimeter of the sidewall 232. As shown, two collection chambers 242 are provided (visible in FIG. 16), and each collection chamber 242 receives debris from two secondary cyclone separators 230 which are provided on the exterior of the sidewall 232, although other configurations of collection chambers and separators are possible. In the illustrated embodiment, the two collection chambers 242 are spaced around the perimeter of the sidewall 232 and define a gap 246 therebetween on the rear of the sidewall 232 that can nest a portion of the upright handle assembly 12 (FIG. 1). Both collection chambers 242 are enclosed around their perimeter by the bumped out walls 244, which are radially spaced from the primary separator sidewall 232. Each collection chamber 240, 242 is open at their bottom edge, which are collectively closed by the door 222, which, when closed, forms the bottom of the collection chambers 240, 242.

The bumped out walls 244 can house at least a portion of the secondary cyclones 230. As illustrated, each bumped out wall 244 houses the lowermost ends of two adjacent frusto-conical secondary cyclones 230. However, it is contemplated that the bumped out walls 244 can be configured to house the entirety of the cyclones 230 instead of merely housing the lower ends thereof.

Figure 18:
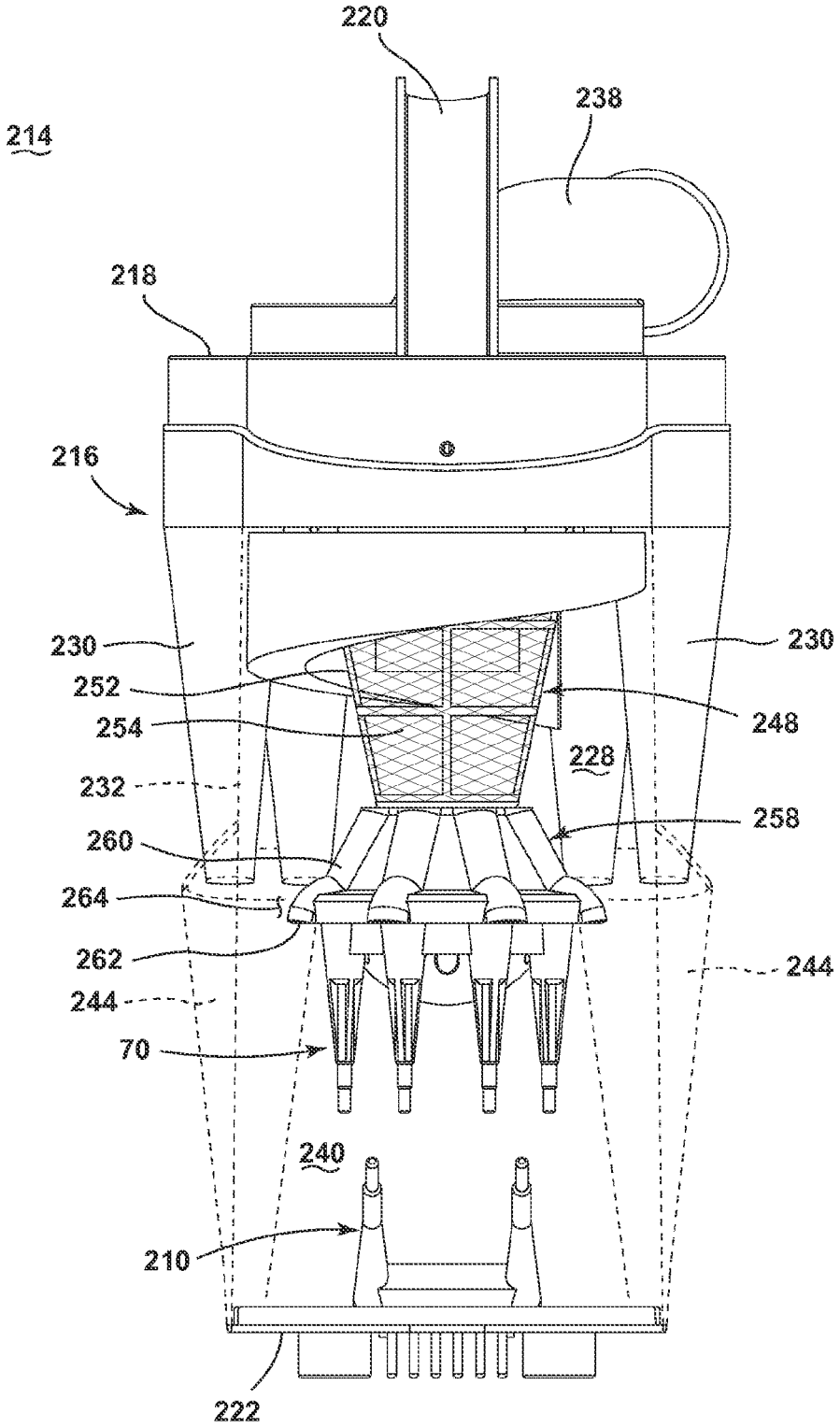
FIG. 18 is a front view of the separation module, illustrating the appearance of a transparent portion of the separation module.

FIG. 18 is a front view of the separation module 214. The housing 216 can be at least partially formed by transparent material such that the interior and/or rear components of the separation module 214 can be viewed by a user. In one configuration, the sidewall 232 and the bumped out walls 244 can be formed from transparent material (as indicated by the phantom lines used in FIG. 18) such that the secondary cyclones 230 are at least partially visible when the separation module 214 is viewed from the front. Moreover, the secondary cyclones 230 and the bumped out walls 244 can extend laterally beyond the perimeter of the sidewall 232 when viewed from the front of the module 214 so that the secondary cyclones 230 and second collection chambers 242 are more visible when viewed from the front of the vacuum cleaner 10. With a transparent sidewall 232, the tines 70, 210 and the contents of the collection chambers 240, 242 will also be visible.

Referring to FIGS. 17-18, the multi-cyclone separation module 214 further comprises an exhaust grill assembly 248 within the housing 216, which is fluidly positioned downstream of the primary separation chamber 228 and upstream of the secondary cyclone separators 230. The grill assembly 248 can comprise a downwardly tapered or conical shaped frame 252 and can further comprise mesh screen 254 wrapped around the support frame 252. The screen 254 comprises a plurality of openings through which air may pass. A separator plate 258 can extend radially outwardly from a lower end of the grill frame 252. The separator plate 258 includes an outwardly flared skirt 260 with an open top mounted to a lower end of grill frame 252 and an open bottom defined by a downwardly-depending lip 262 on the skirt 260. The skirt 260 flares outwardly in a downward direction such that the lip 262 defines the outer perimeter of the separator plate 258.

A primary debris outlet 264 from the primary separation chamber 228 can be defined between the lip 262 of the separator plate 258 and the sidewall 232. A secondary debris outlet 266 from each cyclone separator 230 is defined by the open bottom of the secondary cyclone 230. A conduit 268 inside the frame 252 defines at least a portion of a fluid conduit leading from the primary separation chamber 228 to the inlets of the secondary separation chambers 230.

Figure 19:
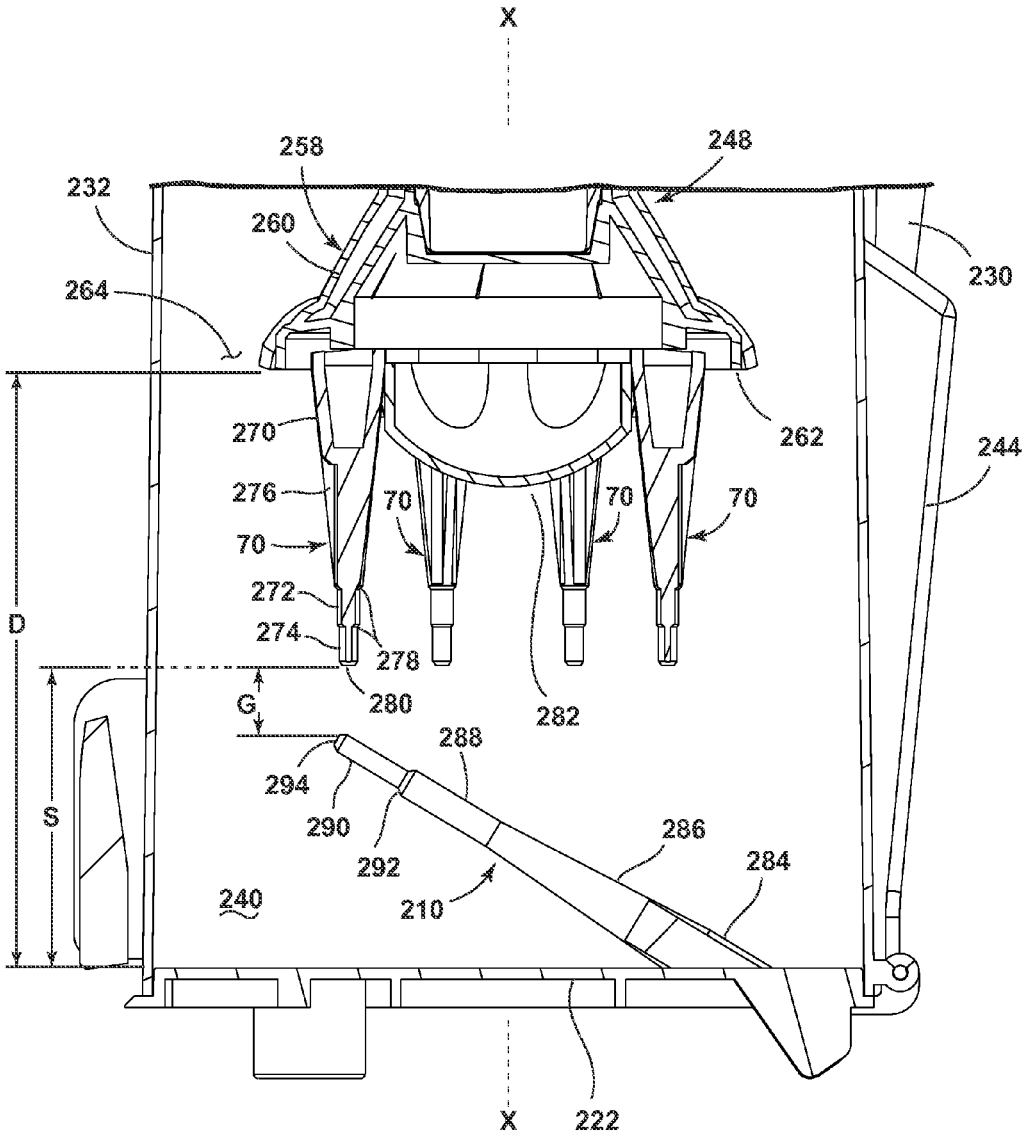
FIG. 19 is a close-up, sectional view through a lower portion of the separation module from FIG. 15 to illustrate configuration of debris catching tines.

FIG. 19 is a close-up, sectional view through a lower portion of the separation module from FIG. 15 to illustrate configuration of debris catching tines 70, 210. Debris catching tines 70 depend downwardly from the grill assembly 248 and are oriented vertically or generally parallel to central axis X. In one example, eight tines 70 are arranged in a circular pattern near the outer edge of the separator plate 258. The linear spacing between adjacent tines 70 can about 28 mm and the diameter formed by the ring of tines 70 is about 73 mm, although other dimensions for the lines 70 are contemplated.

Each tine 70 can comprise a conical-shaped member that tapers inwardly from an upper portion 270 to a lower portion 272 having a free terminal end 274. The upper portion 270 can be cored out or hollow, whereas the lower portion 272 can comprise a solid, thin stiff rod. The tines 70 can further comprise external, tapered ribs 276 for stiffening and improving durability of the tines 70. The ribs 276 can project radially from the outer surface of each tine 70, but gradually taper down and blend into the surface of the lower end 272. In the embodiment shown, each tine 70 comprises four orthogonal ribs 276. The tines 70 are preferably molded out of a thermoplastic material such as acrylonitrile butadiene styrene (ABS) or polypropylene (PP), for example.

The lower portion 272 of each tine 70 can further comprise at least one inward step 278 that reduces the diameter of the tine 70 at the terminal end 274. The terminal end 274 can also include a rounded tip 280. The step 278 and rounded tip 280 are configured to enhance release of debris and hair from the tines 70. As shown, the lower portion 272 includes two inward steps 278 that successively reduce the diameter of the tine 70 at the terminal end 274. In one example, each inward step 278 can reduce the diameter of the tine 70 by about 0.5 mm to 2.5 mm and preferably within a range between about 0.75 mm to 1.5 mm, although using larger or smaller steps 278, as well as omitting one or all steps, is also contemplated. In another embodiment, the lower portion 272 of the tine 70 can be smoothly tapered in order to gradually reduce the diameter of tine 70 toward the terminal end 274 without the use of one or more discrete steps 278.

The conical configuration of the vertical tines 70 of the seventh embodiment can also tend to enhance shedding and release of debris collected by the tines 70. In one example the diameter of the upper portion 270 at the top of a tine 70 is about 16 mm and the diameter of the terminal end 274 is about 4 mm. Thus, the conical tine configuration can be approximated by a ratio of tine diameters along the length of the tine 70 such that the diameter of the upper portion 270 at the top of a tine 70 is about four times the diameter of the terminal end 274, or a ratio of about 4:1. However, a range of tine diameter ratios is contemplated, such as from about 2:1 to about 7:1.

Similarly, the conical configuration of the tines 70 can be expressed as a ratio of tine length to the diameter of the upper portion 270 at the top of a tine 70. In one example, the length of the tine 70 is about 67 mm and the diameter of the upper portion 270 at the top of a tine 70 is about 16 mm. Thus, the conical tine configuration can be approximated by a ratio such that tine length is about four times the diameter of the tine diameter taken at the upper portion 270 at the top of a tine 70, or a length-to-diameter ratio of about 4:1. However, a range of length-to-diameter ratios are contemplated, such as ratios from about 2:1 to 10:1.

In the illustrated embodiment, the tines 70 about half the distance D between the bottom of the separator plate 258 and the bottom door 222. In one example, the distance D can be 128 mm and the distance S from the terminal ends 274 of the tines 70 to the bottom door 222 is 64 mm. Thus, in this example the tines 70 extend into the first collection chamber 240 about 50% of the distance D. However, it is contemplated that in alternate embodiments, the tines 70 can extend a length greater than or less than half the distance D between the separator plate 258 and the bottom door 222 to achieve desired performance and depending on the configuration of the module 214.

A debris guard 282 can be mounted beneath the grill assembly 248, within the circular grouping of tines 70 to prevent debris from becoming lodged and stuck between the tines 70 and the grill assembly 248. In one example, the debris guard 282 comprises a convex or dome-shaped member in the center of the grouping of tines 70. However, the debris guard 282 can comprise other shapes, such as flat, concave or a combination thereof, for example.

The separation module 214 further includes angled tines 210 provided on the bottom door 222 of the housing 216, similar to the previous embodiment. The angled tines 210 can be formed out of a semi-resilient material that is resistant to abrasion and less prone to breakage than a more brittle material. In one example, the angled tines 210 can be molded out of a thermoplastic polyurethane (TPU) having a durometer of about 70 or 80 shore A, although other materials are contemplated, including those having higher or lower hardness levels.

One or more angled tines 210 can extend upwardly from a bottom door 222 into the first collection chamber 240. The angled tines 210 can be fastened to the bottom door 222 by mechanical fasteners (not shown) or other manufacturing methods such as heat staking, adhesive, or welding, for example. In the illustrated embodiment, a pair of angle tines 210 is attached to the bottom door 222 via a common mount 284 provided on the upper surface of the bottom door 222.

Each tine 210 can comprise a conical-shaped member that tapers inwardly from a lower portion 286 at the mount 284 to an upper portion 288 having a free terminal end 290. The entire tine 210 can comprise a solid, thin stiff rod, or may be at least partially hollow. While not shown, the tines 210 can further comprise external ribs, similar to the ribs 276 described above for the vertical tines 70.

The angled tines 210 can also be tapered along their length such that the terminal ends 290 are a smaller diameter compared to the diameter of the angled tine 210 near the mount 284. The upper portion 288 can further comprise one or more inward steps 292 and a rounded tip 294, which further reduce the diameter of the tines 210 at the terminal ends 290 and enhance shedding and release of debris. In one example, the diameter of the angled tine 210 at the lower portion 286 near the mount 284 is about 12.5 mm and the diameter of the tine 210 at the terminal end 290 is about 4 mm. In this example, the ratio of tine diameters along the length of the tine 210 is about 3:1. Additionally, the length of the angled tine 210 is about 89 mm and the largest diameter taken near the mount 284 is about 12.5 mm. Thus, the length-to-diameter ratio of the angled tine 210 is about 7:1. However, similar to the vertical tines 70, a range of length-to-diameter ratios is contemplated for the angled tines 210, such as ratios from about 2:1 to about 10:1.

A vertical gap G can be provided between the terminal ends 274 of the vertical tines 70 and the terminal ends 290 of the angled tines 210, and is measured along a plane parallel to the central axis X of the module 214. In one example, the gap G is about 15 mm, which test results have shown to provide desirable performance. However, other configurations are contemplated, including a zero or negative gap—meaning that the terminal ends 274, 290 of the vertical and angled tines 70, 210 can be co-planar or can intersect/overlap each other.

Figure 20:
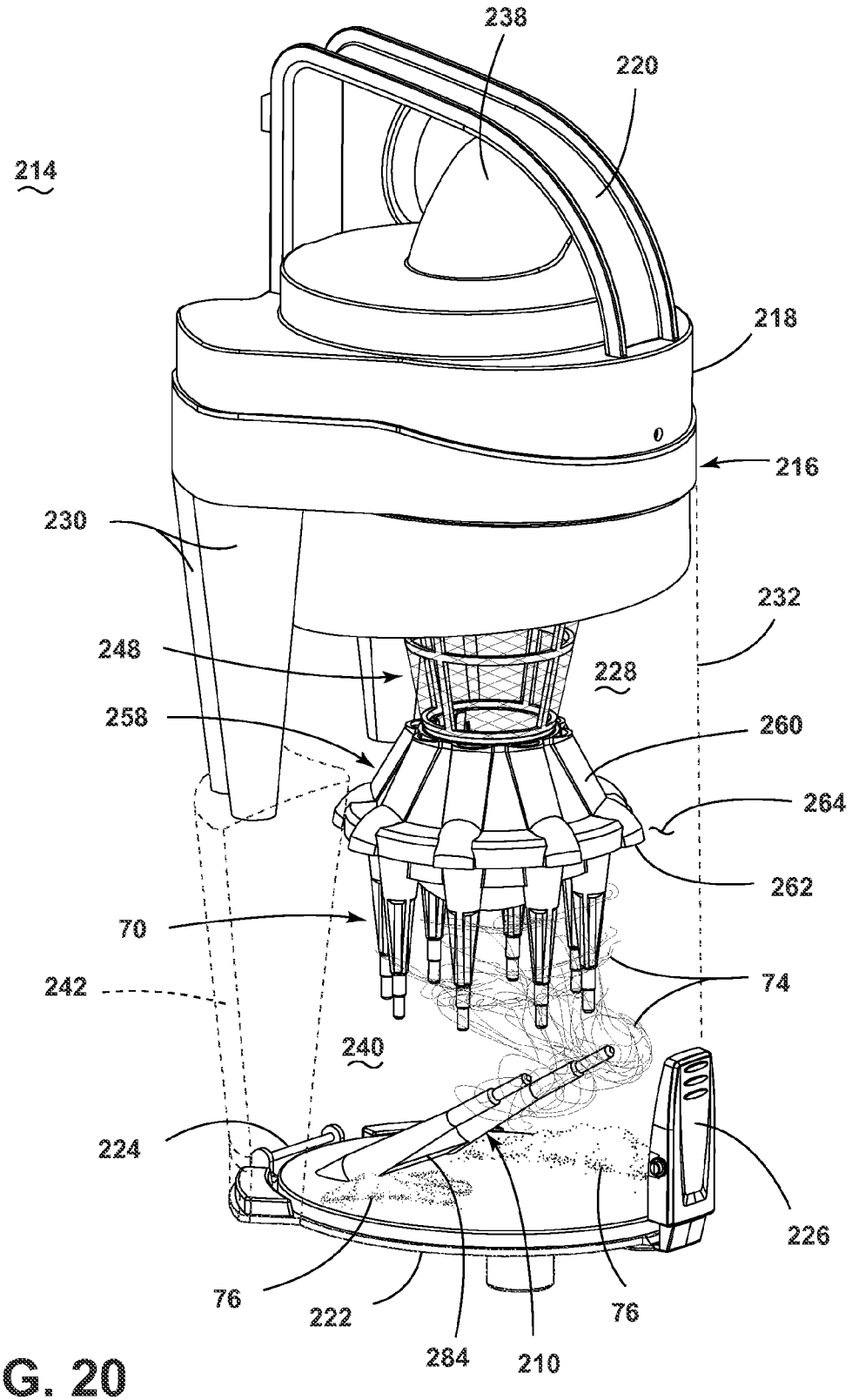
FIG. 20 is a perspective view of the separation module from FIG. 15 illustrating the collection of debris in the separation module during operation.
Figure 21:
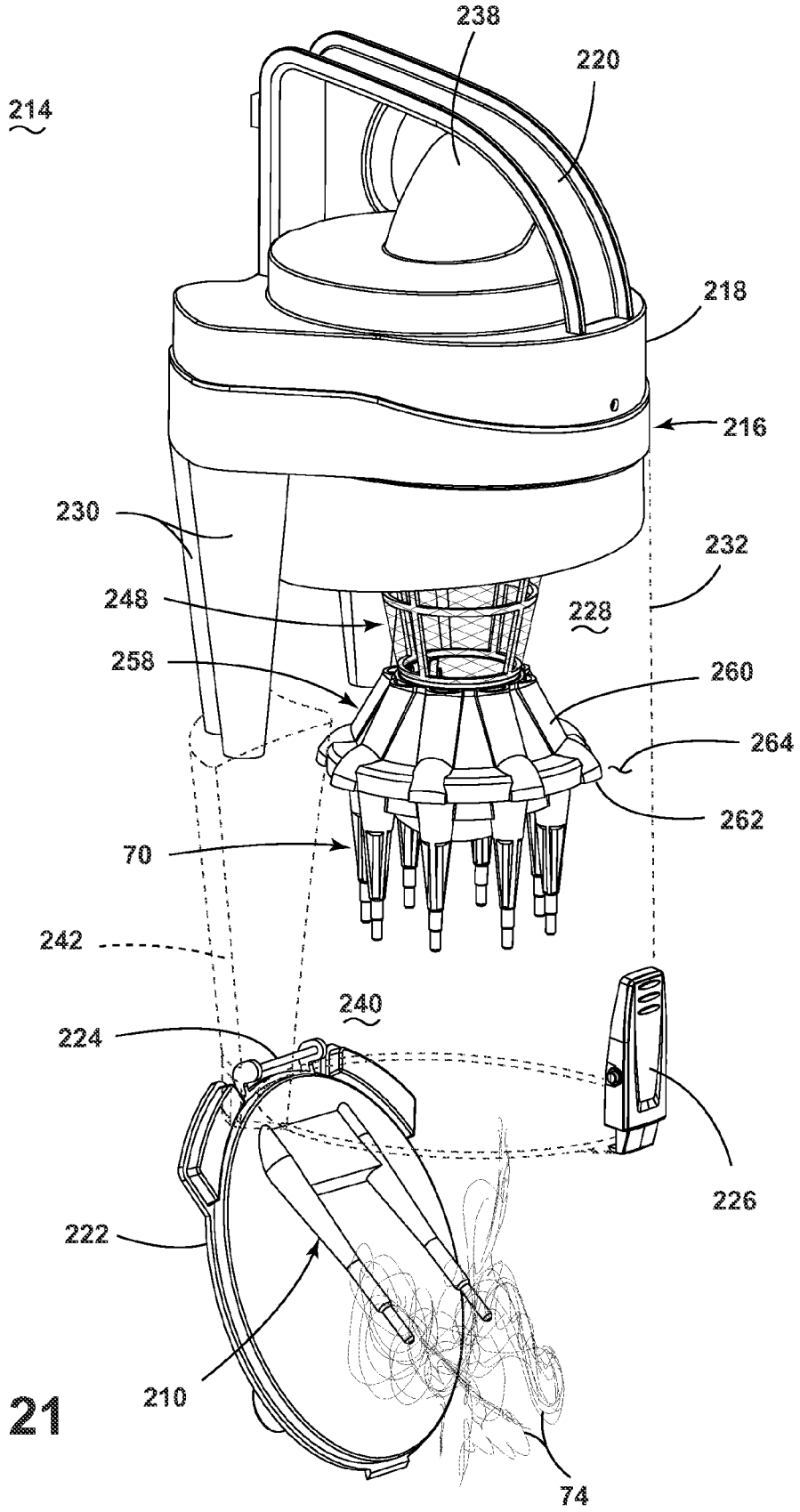
FIG. 21 is a view similar to FIG. 20, illustrating the emptying of debris in the separation module during operation.

FIG. 20-21 are perspective views of the separation module 214, illustrating the collection and emptying of debris in the separation module 214 during operation. In operation, string-like or elongated debris 74 entrained within the swirling airflow are caught and retained on the tines 70, 210 for later disposal, while particle like debris 76, such as dirt, are collected at the bottom of the first collection chamber 240 and second collection chambers 242. Because the secondary cyclones 230 and second collection chambers 242 are positioned outside of the first collection chamber 240, the center of the first collection chamber 240 is unobstructed so that elongated debris 74 may initially collect on the angled tines 210. The elongated debris 74 continues to build up on the angled tines 210 and eventually collects on the vertical tines 70, after which there may be some intertwining of the collected debris 74 between the tines 70, 210.

When the multi-cyclone separation module 214 is emptied, the door 222 is opened and particle-like debris 76 falls out of the open bottoms of collection chambers 240, 242. In addition to collecting debris, the angled tines 210 can have a second function of acting as a tine stripper mechanism for stripping the elongated or string-like debris 74 from the tines 70. As the door 22 opens, the angled tines 210 intersecting the elongated debris 74 collected on the vertical tines 70 can pull or strip off the debris 74 on the vertical tines. The intertwining of the collected debris 74 between the tines 70, 210 may also help to pull or strip off the debris 74 on the vertical tines 70. When the door 222 is fully open, the debris 74 sheds or falls off the tines 70, 210. The conical shape, the steps 278, 292, and the rounded tips 280, 284 on the terminal ends 274, 290 of the tines 70, 210 enhance release of debris 74 from the tines 70, 210 by gravity, although a user can shake or manually wipe off the tines 70, 210 if necessary.

The above described embodiments provide for a variety of benefits, including improved debris collection in vacuum cleaner separation modules. These features, alone or in combination, create a superior separation module for vacuum cleaners. One advantage that may be realized in the practice of some embodiments of the described separation module is that debris catching tines are provided with the grill assembly, which prevents elongated or string-like debris from wrapping around and blocking or clogging the openings of the exhaust grill. Previous separation modules have included features directed toward discouraging or preventing re-entrainment of collected dirt particles into the working air flow, but these do not address particular issue of elongated or string-like debris wrapping around the exhaust grill.

Another advantage that may be realized in the practice of some embodiments of the described separation module is that a tine stripper mechanism can be provided for stripping elongated or string-like debris from the debris catching tines without requiring a user to manually pull the debris from the tines. The tine stripper mechanism can even be integrated with an existing emptying mechanism, such as a bottom dirt door.

Another advantage that may be realized in the practice of some embodiments of the described separation module is that the tines have a rod-like or conical shape, which tends to improve shedding and release of debris.

Yet another advantage that may be realized in the practice of some embodiments of the described separation module is that, in the case of a multi-stage module, positioning the secondary separation stage outside the primary separator separation stage provides more space within the primary separation stage and primary for separating and collecting string-like or elongated debris 74, which can be somewhat voluminous as it collects and becomes intertwined on the tines in the primary collection chamber. Prior art multi-cyclonic separators commonly position one or more secondary separators and a secondary collection chamber concentrically within the primary separator, which occupies volume at the center of the separation module. Thus, less volume is available in the primary separator and collection module for separating and collecting string-like or elongated debris 74. Also, because elongated debris 74 typically tends to collect at the center of the collection chamber, occupying that volume with secondary separators and collection chamber is not ideal, because the elongated debris 74 is prevented from agglomerating, collecting and intertwining at the center of the chamber and could be prone to re-entrainment. Additionally, less volume is available in the primary collection chamber, which causes the primary collection chamber to fill more quickly and requires a user to empty the tank frequently. The separation module design disclosed herein ameliorates problems with prior art designs by moving the secondary separators and collection chambers outside the primary separator and collection chamber. Because the secondary separator does not occupy the central portion of the primary, the elongated debris 74 is free to agglomerate, collect and intertwine on the tines for later disposal.

While the invention has been specifically described in connection with certain specific embodiments thereof, it is to be understood that this is by way of illustration and not of limitation. For example, while the cyclone module assemblies illustrated herein are shown having a single stage separator or two concentric stages of separation, it is understood that the tines could be applied to a separator with multiple parallel first and/or second stage, or additional downstream separators, or other types of cyclone separators. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A vacuum cleaner, comprising:

a housing comprising a suction nozzle;

a suction source fluidly connected to the suction nozzle creating a working airstream through the housing;

a separation module separating contaminants from the working airstream, the separation module comprising:

at least one separation chamber having an air inlet in fluid communication with the suction nozzle;

an air outlet; and at least one collection chamber which receives contaminants separated by the at least one separation chamber; and an exhaust grill assembly comprising:

an exhaust grill having openings through which the working airstream may pass and mounted within the at least one separation chamber fluidly upstream from the air outlet such that the working airstream passes through the openings of the exhaust grill before reaching the air outlet; and a plurality of debris catching tines extending below the exhaust grill within the at least one collection chamber which prevent elongated debris from wrapping around and blocking the openings of the exhaust grill;

wherein the debris catching tines comprise free terminal ends that are spaced from a bottom wall of the at least one collection chamber.

2. The vacuum cleaner of claim 1, wherein the debris catching tines are vertically-oriented.

3. The vacuum cleaner from claim 2, wherein the exhaust grill is positioned at the center of the at least one separation chamber along a central axis, and the vertically-oriented debris catching tines extend downwardly below the exhaust grill.

4. The vacuum cleaner of claim 1, wherein the debris catching tines are horizontally-oriented.

5. The vacuum cleaner from claim 4, wherein the horizontally-oriented debris catching tines are stacked below the exhaust grill.

6. The vacuum cleaner of claim 4, wherein the exhaust grill is positioned at the center of the at least one separation chamber along a central axis, and each debris catching tine is curved such that the tine bends around the central axis.

7. The vacuum cleaner of claim 1, wherein the debris catching tines comprise elongated bodies.

8. The vacuum cleaner of claim 7, wherein the elongated bodies comprise circular cross-sections.

9. The vacuum cleaner of claim 1, wherein the exhaust grill assembly further comprises a separator plate at a lower portion of the exhaust grill to separate the at least one separation chamber from the at least one collection chamber, wherein the debris catching tines depend downwardly from the separator plate.

10. The vacuum cleaner of claim 9, wherein the debris catching tines extend at least half of the distance between the separator plate and a bottom wall of the at least one collection chamber.

11. The vacuum cleaner of claim 9, wherein the debris catching tines are radially spaced from each other around a periphery of the separator plate.

12. The vacuum cleaner of claim 1 and further comprising a tine cleaner configured to clean elongated debris from the debris catching tines.

13. The vacuum cleaner of claim 1, wherein the separation module comprises a multiple stage separation module having at least one additional separation chamber fluidly downstream from the exhaust grill and fluidly upstream from the air outlet.

14. The vacuum cleaner of claim 1, wherein the openings of the exhaust grill are defined by one of louvers or perforations.

15. A vacuum cleaner, comprising:

a housing comprising a suction nozzle;

a suction source fluidly connected to the suction nozzle creating a working airstream through the housing;

a separation module separating contaminants from the working airstream, the separation module comprising:

at least one separation chamber having an air inlet in fluid communication with the suction nozzle;

an air outlet; and at least one collection chamber which receives contaminants separated by the at least one separation chamber;

an exhaust grill assembly comprising:

an exhaust grill having openings through which the working airstream may pass and mounted within the at least one separation chamber fluidly upstream from the air outlet such that the working airstream passes through the openings of the exhaust grill before reaching the air outlet; and a plurality of debris catching tines extending below the exhaust grill within the at least one collection chamber which prevent elongated debris from wrapping around and blocking the openings of the exhaust grill; and a tine cleaner configured to clean elongated debris from the debris catching tines.

16. The vacuum cleaner of claim 15, wherein the tine cleaner comprises at least one angled tine provided within the at least one collection chamber.

17. The vacuum cleaner of claim 16, wherein the at least one collection chamber comprises a moveable door defining a bottom surface to the at least one collection chamber, wherein the angled tines are provided on the door and extend upwardly from the door at an angle.

18. The vacuum cleaner of claim 16, wherein at least one of the plurality of debris catching tines comprises a free terminal end and the at least one angled tine comprises a free terminal end, wherein the free terminal ends are separated from each other by a gap.

19. The vacuum cleaner of claim 16, wherein the tine cleaner comprises a tine plate from which the debris catching tines extend and a stripper plate having a plurality of slots for receiving the debris catching tines, whereby movement of the tine plate relative to the stripper plate cleans elongated debris from the debris catching tines.

20. The vacuum cleaner of claim 19, wherein the tine cleaner further comprises a handle attached to one of the tine plate and the stripper plate for moving the one of the tine plate and the stripper plate relative to the other of the tine plate and the stripper plate.

* * * * *